US006550879B1

(12) United States Patent
Kurrasch et al.

(10) Patent No.: US 6,550,879 B1
(45) Date of Patent: Apr. 22, 2003

(54) CABINET STRUCTURE

(75) Inventors: Andrew J. Kurrasch, Saugatuck, MI (US); Michele Bekins, Spring Lake, MI (US); Stephen R. Teays, Spring Lake, MI (US)

(73) Assignee: Herman Milles, Inc., Zeeland, MI (US)

( * ) Notice: Subject to any disclaimer, the term of this patent is extended or adjusted under 35 U.S.C. 154(b) by 0 days.

(21) Appl. No.: 08/155,946

(22) Filed: Nov. 19, 1993

Related U.S. Application Data

(63) Continuation-in-part of application No. 07/983,441, filed on Dec. 1, 1992, now abandoned.

(51) Int. Cl.[7] ..... A47B 47/00

(52) U.S. Cl. ..... 312/257.1; 312/263; 312/265.5; 52/801.11; 428/593

(58) Field of Search ..... 312/257.1, 263, 312/265.5; 52/270, 265, 268, 808, 801.11, 784.14, 790.1; 428/593

(56) References Cited

U.S. PATENT DOCUMENTS

| | | | | |
|---|---|---|---|---|
| 1,178,612 A | | 4/1916 | Weiss | |
| 1,397,269 A | | 11/1921 | Dodge | |
| 1,523,653 A | | 1/1925 | Larson et al. | |
| 2,020,337 A | * | 11/1935 | Schwartz | 52/784.14 |
| 2,162,333 A | | 6/1939 | Golden | |
| 2,559,099 A | | 7/1951 | West | |
| 2,613,623 A | | 10/1952 | Behrens | |
| 2,719,809 A | * | 10/1955 | Herts | 156/293 X |
| 2,749,199 A | | 6/1956 | O'Connor | |
| 2,765,056 A | * | 10/1956 | Tyree | 52/784.14 X |
| 2,793,718 A | * | 5/1957 | Pajak | 428/593 X |
| 2,808,307 A | | 10/1957 | Heilman et al. | |
| 2,901,781 A | | 9/1959 | Sha'ag | |
| 2,911,274 A | | 11/1959 | Grube | |
| 3,029,910 A | * | 4/1962 | Kirk et al. | 428/593 |
| 3,095,625 A | | 7/1963 | Propst | |
| 3,192,306 A | * | 6/1965 | Skonnard | 312/265.5 X |
| 3,295,279 A | * | 1/1967 | Wilkins | 52/268 |

(List continued on next page.)

FOREIGN PATENT DOCUMENTS

| | | | | |
|---|---|---|---|---|
| CA | 1 186 721 | | 5/1985 | |
| DE | 25 52 571 | | 6/1977 | |
| DE | 91 05 346.3 | | 6/1991 | |
| DK | 61314 | * | 9/1943 | 52/784.14 |
| FR | 1083832 | * | 1/1955 | 312/257.1 |
| FR | 1383986 | * | 11/1964 | 52/790.1 |
| GB | 1279405 | * | 6/1972 | 52/784.14 |
| GB | 2056888 | * | 3/1981 | 428/593 |
| WO | WO 89/00825 | | 2/1989 | |

*Primary Examiner*—John G. Weiss
*Assistant Examiner*—Michael Fisher
(74) *Attorney, Agent, or Firm*—Brinks Hofer Gilson & Lione

(57) ABSTRACT

A cabinet having a wall comprising an inner wall and an outer wall attached to the inner wall. A strengthening piece or material is positioned between the inner wall and the outer wall to provide strength and rigidity to the wall. Preferably, the strengthening piece or material has a honeycomb structure.

69 Claims, 18 Drawing Sheets

U.S. PATENT DOCUMENTS 3,333,385 A * 8/1967 King ..... 52/784.14 X
3,341,270 A 9/1967 Sohl
3,430,997 A 3/1969 Propst et al.
3,572,263 A 3/1971 Propst
3,594,055 A 7/1971 Lohr et al.
RE27,215 E 11/1971 Propst et al.
3,819,466 A 6/1974 Winfield et al.
3,826,554 A 7/1974 Cornell
3,853,367 A * 12/1974 Jamison et al. ..... 312/259
3,856,374 A 12/1974 Christen
3,927,924 A 12/1975 Kelley
4,014,143 A 3/1977 Purcell
4,233,495 A 11/1980 Scoville et al.
4,338,990 A * 7/1982 Blodee et al. ..... 312/263 X
4,550,545 A 11/1985 Schulz
RE32,890 E 3/1989 DeFouw et al.
4,836,626 A 6/1989 Taylor et al.
4,875,552 A * 10/1989 Smith et al. ..... 187/1 R
4,902,365 A * 2/1990 Westlake, Sr. ..... 156/308.4 X
5,058,347 A 10/1991 Schuelke et al.
5,106,173 A 4/1992 Kelley et al.

* cited by examiner

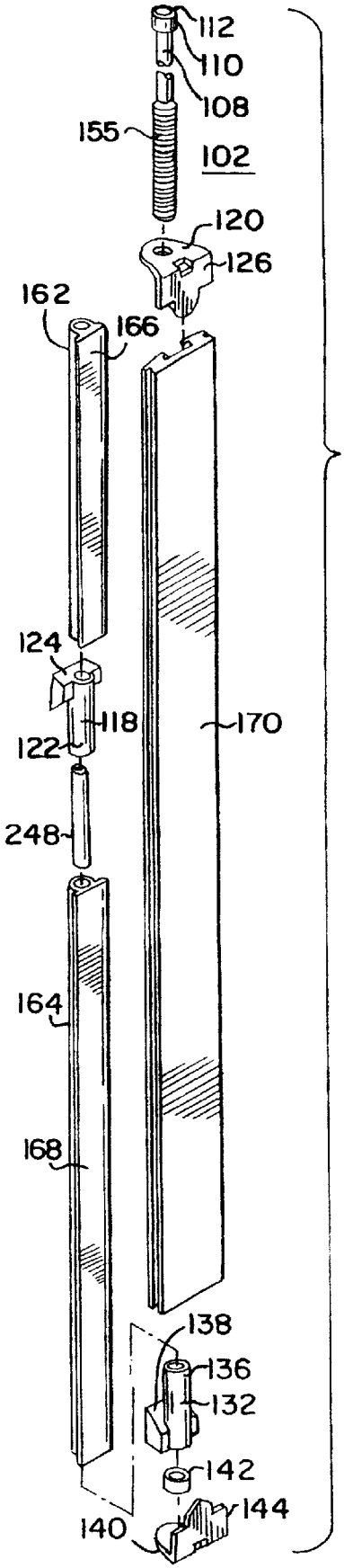
FIG. 21
FIG. 24
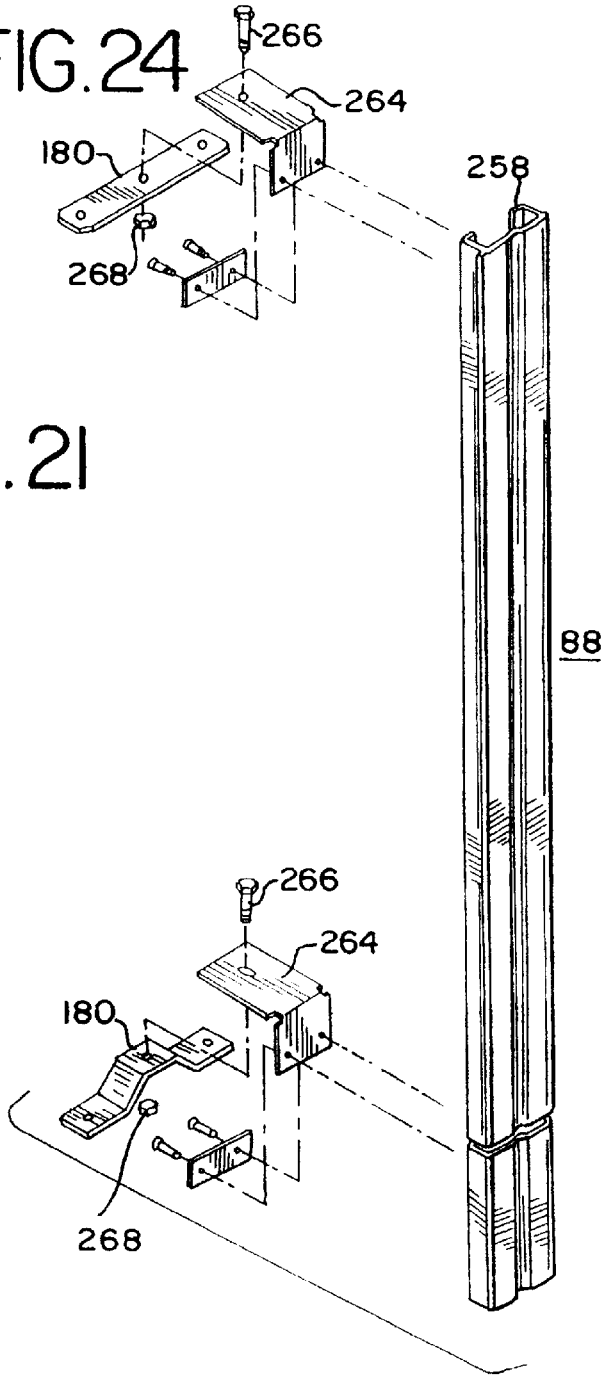

CABINET STRUCTURE

This application is a continuation-in-part of U.S. application Ser. No. 07/983,441, filed Dec. 1, 1992, now abandoned.

BACKGROUND OF THE INVENTION

1. Field of the Invention

This invention relates to a cabinet structure having a wall structure with improved strength and sound absorption.

There is also disclosed a connector system for connecting a cabinet to either a panel, a second cabinet, or both a panel and a second cabinet.

2. Discussion of Related Art

In the past, cabinets were commonly constructed from a frame structure comprising four vertical posts arranged at the vertices of a rectangle where adjacent posts were connected to each other by horizontal bars. Single sheets of sheet metal were attached to adjacent vertical posts so as to form the bottom, top, side walls, and rear wall of the cabinet. Shelving was inserted in the interior of the cabinet and attached to the vertical posts. Drawers or doors were attached to the other side of the cabinet.

A conventional cabinet structure is shown in U.S. Pat. No. 2,749,199. The '199 patent discloses a rectangular base which supports the cabinet on the ground. The base has flanges on each of its four sides. Connected to the base at the flanges are two rectangular sides and a rectangular back wall. The two side walls and the back wall are each made of sheet metal. A top for the cabinet comprises a rectangular sheet having three flanges. The top is connected to the back wall and side walls at the flanges. The above described structure, however, employs single sheets for the walls resulting in inadequate strength and sound absorption for the walls.

In U.S. Pat. No. 2,162,333 to Golden, the strengthening of cabinet doors has been attempted by the insertion of corrugated paper boards between the door facing, and a door liner. While in U.S. Pat. No. 3,819,466, the strengthening of panels in buildings has been attempted by placing a corrugated layer between an inner skin and outer skin of the building panel.

SUMMARY OF THE INVENTION

The above-mentioned disadvantages are overcome by the present invention which is a cabinet having a panel comprising an inner wall and an outer wall attached to the inner wall, wherein a strengthening piece or material is positioned in the cavity located between the inner wall and the outer wall.

The present invention presents many advantages such as providing improved strength to the panels or walls. The strength is improved to such an extent that a frame is not needed to support the top, bottom, rear wall, side walls, or rear wall of a cabinet. The panels and walls themselves serve as the cabinet structure as compared with a cabinet having walls placed over a frame. This leads to improved savings in cost and construction time.

The present invention provides an improved panel to resist shear forces so that buckling is reduced during bending of the panel. Thus, should the cabinet panels be attached to an office panel system, the loads on the cabinet are compensated for allowing file drawers and flipper doors attached to the cabinet to be opened and closed.

Furthermore, the present invention reduces the irritating tinny, metallic sound characteristic of sheet metal cabinets.

Thus, the present invention substantially deadens sound so that a more aesthetically pleasing working environment is produced.

BRIEF DESCRIPTION OF THE DRAWINGS

FIG. 21 is an exploded view of a second embodiment of a connector for attachment of a side panel of the embodiment of the cabinet of FIG. 1 with a panel having a lesser height;

FIG. 24 is an exploded view of an embodiment of a connector for attachment of a side panel of a first cabinet according to the embodiment of FIG. 1 with both (1) a panel oriented at a 90° angle and (2) a side panel of a second cabinet of the cabinet of FIG. 1 and oriented parallel to the side panel of the first cabinet;

DESCRIPTION OF THE PREFERRED EMBODIMENT

Figure 1:
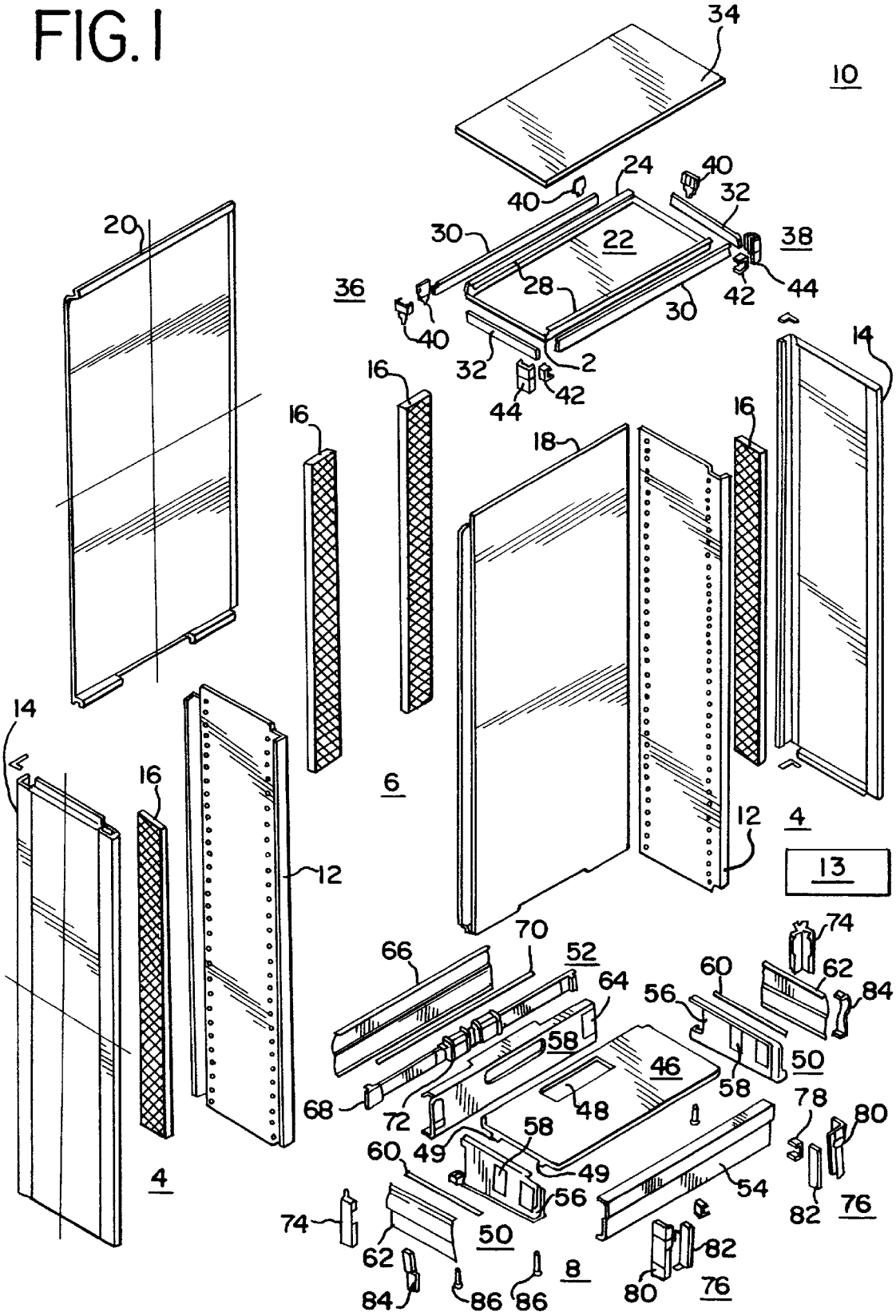
FIG. 1 is an exploded view of an embodiment of a cabinet according to the present invention.

A cabinet according to the preferred embodiment is schematically shown in the exploded view of FIG. 1. The cabinet 2 has two sides such as side walls or panels 4, a rear side such as a rear wall or panel 6, a bottom piece 8 and a top piece 10. The two side walls 4 and the rear wall 6 each possess a sandwich-like structure to provide improved strength and rigidity.

As an example of the sandwich-like structure, the side wall 4 comprises a rectangular metallic inner wall 12 and a metallic outer wall 14 which are attached to each other by welding or other known methods. Each inner wall 12 preferably contains a plurality of holes to allow for insertion of shelves 13 in a well known manner. A shelf 13 is represented by a box labeled with the numeral 13, the box in no way should be construed as indicating either the shape or dimensions of the shelf 13. Before attachment of the inner and outer walls, a substantially rectangular strengthening piece or material 16 is inserted in the substantially rectangular cavity defined between the inner and outer walls 12 and 14, respectively. Strengthening piece or material 16 preferably is made of paper or cardboard. Strengthening piece or material 16 preferably is centrally located so as to strengthen the wall 4 uniformly. To achieve uniform strengthening, strengthening piece or material 16 is symmetrically positioned about the two planes of symmetry A and B which are oriented perpendicular to each other along the length and width of either side wall 4, the inner wall 12 or outer wall 14. The strengthening piece 16 is rectangular, has a length of approximately 45" and a width of approximately 4". The size of strengthening piece 16 is dependent on the amount of strength desired (the greater the size the greater the strength) and the amount of cost desired (the lesser the size the lesser the cost).

The strengthening piece 16 is attached to both the inner wall 12 and outer wall 14 by appropriate devices. For example, due to the dissimilar nature of the metal inner and outer walls, 12, 14 and the paper-like material for strengthening piece or material 16 attachment by an adhesive, such as Flexbond 165 available from Air Products and Chemicals of Lehigh, Pa., is preferred.

Strengthening piece or material 16 preferably has a thickness of approximately 0.781". The thickness of strengthening piece or material 16 is chosen such that strengthening piece or material 16 contacts both walls 12 and 14. It should be noted that other shapes for strengthening piece or material 16 are possible, such as a square or a circle. In addition, the strengthening piece or material 16 may be used for panels or walls having non-rectangular shapes, such as triangles, pentagons, or hexagons.

Figure 27:
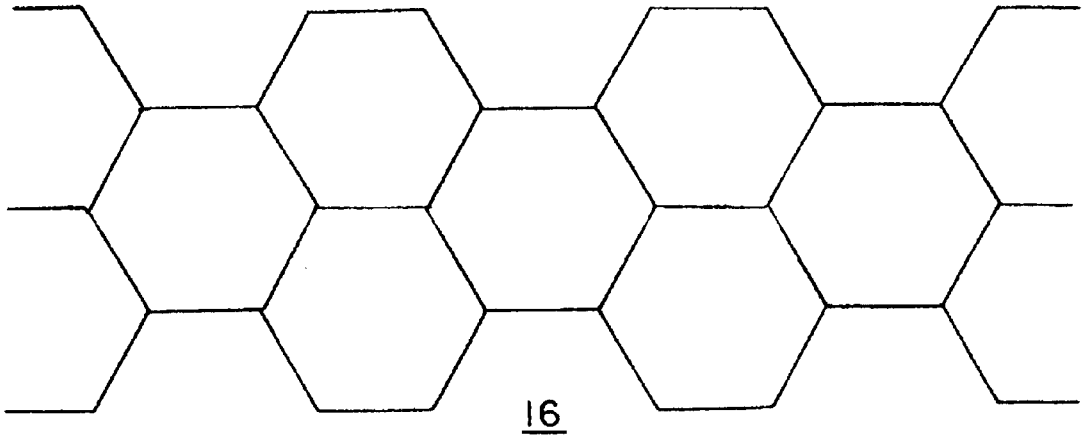
FIG. 27 schematically shows a front portion of a honeycomb structure that can be used with the cabinet of FIG. 1.

The strengthening piece or material 16 preferably has a regular pattern of hexagonal apertures forming a honeycomb structure. It is well known in the art that such a honeycomb structure is unitary and comprises a pattern of apertures that comprises a plurality of interconnected columns having two or more vertically aligned apertures wherein abutting apertures of adjacent columns are vertically offset from one another so that no two abutting apertures of adjacent columns form a horizontal row and instead form a plurality of rows that form an acute angle with the columns as schematically shown in FIG. 27. An example of such a honeycomb structure made from paper or cardboard is available from Hexagon Corporation located in Kalamazoo, Mich. The apertures are facing the inner and outer side walls 12 and 14. The honeycomb apertures are each in the shape of a regular hexagon wherein each side of the hexagon has a length of approximately ⅜". Furthermore, two of the sides of the hexagonal aperture are parallel with the bottom edge of the wall 4. It is understood that other values for the thickness and lengths of the sides of the hexagon are possible depending on the desired strength and rigidity. Furthermore, though a honeycomb structure is described other patterns employing other shapes for the apertures are possible, such as circles, diamonds, and squares.

The above-described strengthening piece 16 provides improved strength for the cabinet side wall 4 to such an extent that prior art frames are not needed to support the walls. However, it is of course possible to attach the improved walls of the present invention to prior art frames to provide even greater structural strength.

For larger walls, such as rear wall 6, a plurality of strengthening pieces or materials 16 maybe inserted between inner wall 18 and outer wall 20. Each strengthening piece or material 16 is symmetrically positioned with respect to a plane of symmetry C which is oriented along the width of the rear wall 6. Furthermore, both strengthening pieces 16 are symmetrically spaced from each other with respect to a second plane of symmetry D which is oriented perpendicular to the first plane of symmetry C and along the length of the rear wall 6.

Top piece 10 comprises a rectangular pan 22 having a width of approximately 24", 30", 36", 42" or 48" and depths of approximately 16" or 22". Of course the choice of the width and depth of top piece 10 depends on the desired width and depth of the cabinet 2. The front longitudinal side 26 and rear longitudinal side 24 of pan 22 have flanges 28 which extend vertically a distance of approximately 2". Each vertical flange 28 has a longitudinal side element 30 connected thereto and lateral side elements 32 are connected to the lateral sides of pan 22. Connection of the longitudinal and lateral side elements 30 and 32 to the pan 22 is accomplished by well known attachment means, such as clips (not shown) which are adhesively fastened to pan 22. A top cover 34 rests on vertical flanges 28 and is clipped to vertical flanges 28 by a pair of flanges which extend horizontally from the longitudinal side elements 30 so as to engage the top cover 34 and the bottom of flanges 28.

Top corner elements 36 and 38 are provided at rear and front corners, respectively, of top pan 22. Rear corner elements 36 comprise a pair of mating pieces 40 which are oriented perpendicular to each other and are clipped together, so as to form a rear corner element 36. Each of the rear corner elements 36 so formed fit in the rear longitudinal side 30 and the lateral side 32 and are held in place by spring fingers on their bottoms.

At the front corners, corner elements 38 are provided which comprise a unitary front corner piece 44 having two perpendicular sides forming a corner. Each corner piece 44 is retained by a spring clip 42 fitting into the side walls 4.

Attachment of top piece 10 to side walls 4 and rear wall 6 is accomplished by well known attachment means, such as screws.

Bottom piece 8 comprises a rectangular floor 46 and a rectangular base. The rectangular base comprises two side elements 56, a rear element 64, and a front element 54 attached to each other in a well known manner, such as welding. Rectangular floor 46 preferably has a width of approximately 24", 30", 36", 42", and 48" and a depth of approximately 16" and 22", as with pan 22. Floor 46 preferably has an opening 48 for providing access to electrical outlets. Once the rectangular base is constructed, floor 46 is placed thereon and is prevented from sliding forward by tabs 49 which snugly engage side elements 56.

Side elements 56 have apertures 58 for allowing electrical outlets and wiring to be in communication with the interior of the cabinet 2. Outer covers 62 are positioned against side elements 56 to trim the base visually. Trim extensions 84 are snapped onto covers 62 so as to cover the openings defined by covers 62 and front element 54. At the bottom portion of each outer cover 62 is a hook which engages the bottom of a corresponding side element 56. The top portion of each cover 62 is attached to an extruded plastic snap 60. Thus, easy access to the electrical elements contained by side elements 56 and covers 62 is provided.

In a similar manner, rear element 64 has an aperture 58 to receive electrical outlets 72 supported on a harness 68. An outer cover 66 is positioned against rear element 64 to define a space to contain the harness 68. At the bottom portion of each outer cover 66 is a hook which engages the bottom of rear element 64. The top portion of each cover 66 is attached to an extruded plastic snap 70. Thus, easy access to the harness 68 contained by rear element 56 and covers 66 is provided in a manner similar to that explained previously for side elements 56 and covers 62.

Bottom corner elements 74 and 76 are provided at rear and front corners, respectively, of bottom piece 8. Front bottom corner elements 76 comprise a pair of mating pieces 80 and 82 which are oriented perpendicular to each other and are joined together in a well known manner, such as welding. Each of the front bottom corner elements 76 so formed are attached to a side wall 4 by a spring clip 78.

At the rear corners, corner elements 74 are comprised of a pair of mating pieces which are oriented perpendicular to each other and clipped together. Corner elements 74 are attached at their top to the side walls 14 by clips. Furthermore, corner elements 74 comprise VELCRO pads at their bottom to allow for further retention with the cabinet and permit easy removal.

Once bottom piece 8 is constructed the two side walls 4 and rear wall 6 are attached thereto by well known attachment means, such as screws, rivets or welding.

The cabinet according to the present invention is capable of a wide variety of attachment schemes. For example, in the embodiments illustrated in FIGS. 2–26 a cabinet 2 is attached either to a panel 86, another cabinet, or both a panel and another cabinet via a connector 88. In the description of the embodiments of FIGS. 2–26, like elements will be given identical numeral designations. Cabinet 2 is capable of being attached to various panels 86 having heights which are either the same as, larger than, or smaller than the height of side wall 4 of cabinet 2. Attachment is achieved in the various embodiments by simultaneously clamping the top and bottom portions of both the cabinet 2 and panel 86 between a connector 88.

In the embodiment of FIGS. 2–7 and 18–20, panel 86 has the same height as side wall 4 and outer wall 14. Outer wall 14 of side wall 4 comprises a slotted area into which a bracket, comprising right-angled pieces 90 and 92 formed from a single piece, is welded to both the top and bottom of the slotted area. Pieces 90 and 92 each have a slot to receive a tab extending from the bottom of mating piece 40. The end of panel 86 comprises two U-shaped pieces 94 and 96, located at the top and bottom respectively. The U-shaped pieces 94 and 96 preferably have the same width as the end of panel 86. The legs of the top U-shaped piece 94 are preferably longer than the legs of the bottom U-shaped piece 96. Top and bottom pieces 94 and 96 are inverted with respect to each other and are screwed to the panel 86 itself.

Figure 2:
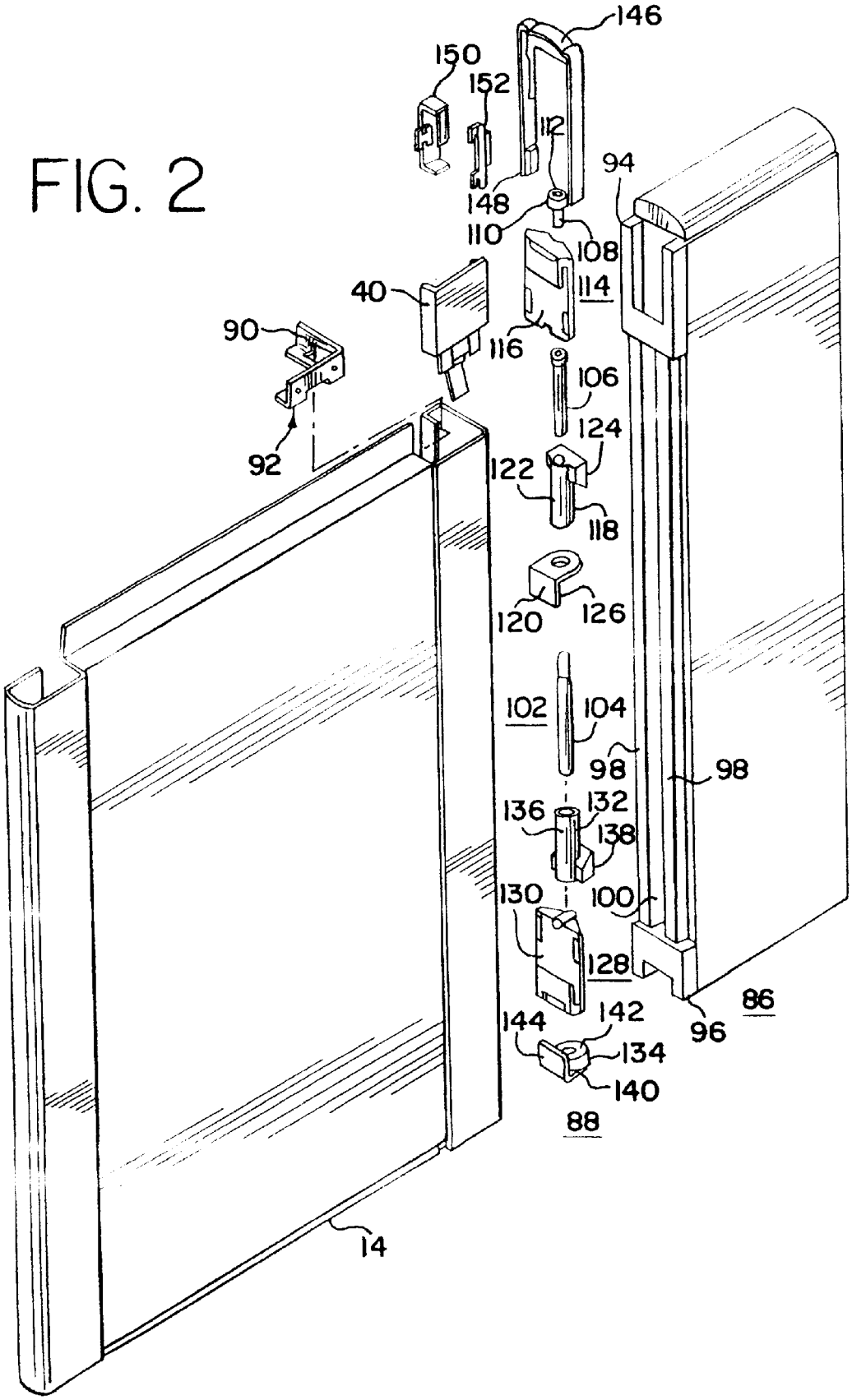
FIG. 2 is an exploded view of an embodiment of a connector for attachment of a side panel of the embodiment of the cabinet of FIG. 1 with a panel having the same height.

In the embodiment of FIG. 2, connector 88 comprises a connection rod 102 with a plurality of connected sections including a threaded base 104, a sleeve 106, and a head 108. Preferably the connected sections are substantially cylindrical in shape though other shapes are possible. The length of middle section 106 is chosen to approximately match the length of cylindrical section 122. Head 108 includes a stop portion 110 located at the end thereof which preferably has a diameter larger than the remaining portion of head 108. Head 108 further includes an opening 112 to receive a hex driver, such as an allen key.

As seen in FIG. 2, connector 88 comprises a top latch element 114 having a top support 116, a top panel mating element 118, and a top side wall mating element 120. Top panel mating element 118 preferably has a cylindrical section 122 having an opening to allow the insertion of connector rod 102 therethrough. A snug fit between rod 102 and the opening of section 122 is accomplished by placing sleeve 106 over that portion of rod 102 which intersects the opening of section 122. Sleeve 106 preferably has a longitudinal slit to allow rod 102 to be easily inserted therein. Top panel mating element 118 fits in a channel in top support 116. Top panel mating element 118 further comprises an engagement piece 124 pointing in a downward direction. Top side wall mating element 120 preferably is attached to the top of support 116 and has an opening to allow the insertion of connector rod 102 therethrough. Top side wall mating element 120 further comprises an engagement piece 126 pointing in a downward direction and parallel to engagement piece 124. Engagement piece 126 is attached to wall 14 by inserting it into a corresponding slot of bracket 90, 92 located in the top of the slot of the wall 14.

Connector 88 similarly comprises a bottom latch element 128 which comprises a bottom support 130, a bottom panel mating element 132, and a bottom side wall mating element 134. As with top panel mating element 118, bottom panel mating element 132 preferably has a cylindrical section 136 having an opening to allow the insertion of connector rod 102 therethrough. Likewise, bottom panel mating element 132 fits in a channel in bottom support 130 and has an engagement piece 138 pointing, however, in an upward direction. Bottom side wall mating element 134 preferably is attached to the bottom of bottom support 130 and has a base 140 to allow connector rod 102 to be supported thereon. An opening such as annular ring 142 is attached to base 140 to allow connector rod 102 to be inserted therein and fix the rod 102 in place. Bottom side wall mating element 134 further comprises an engagement piece 144 pointing in an upward direction and parallel to engagement piece 138. Engagement piece 144 is attached to wall 14 by inserting it into a corresponding slot of bracket 90, 92 located in the bottom of the slot of the wall 14.

Connector rod 102 is then inserted into the openings of cylindrical sections 122, 136 and top and bottom side wall mating elements 120, 134. The base 104 of connector rod 102 preferably is inserted into the opening of bottom side wall mating element.

Figures 3, 4:
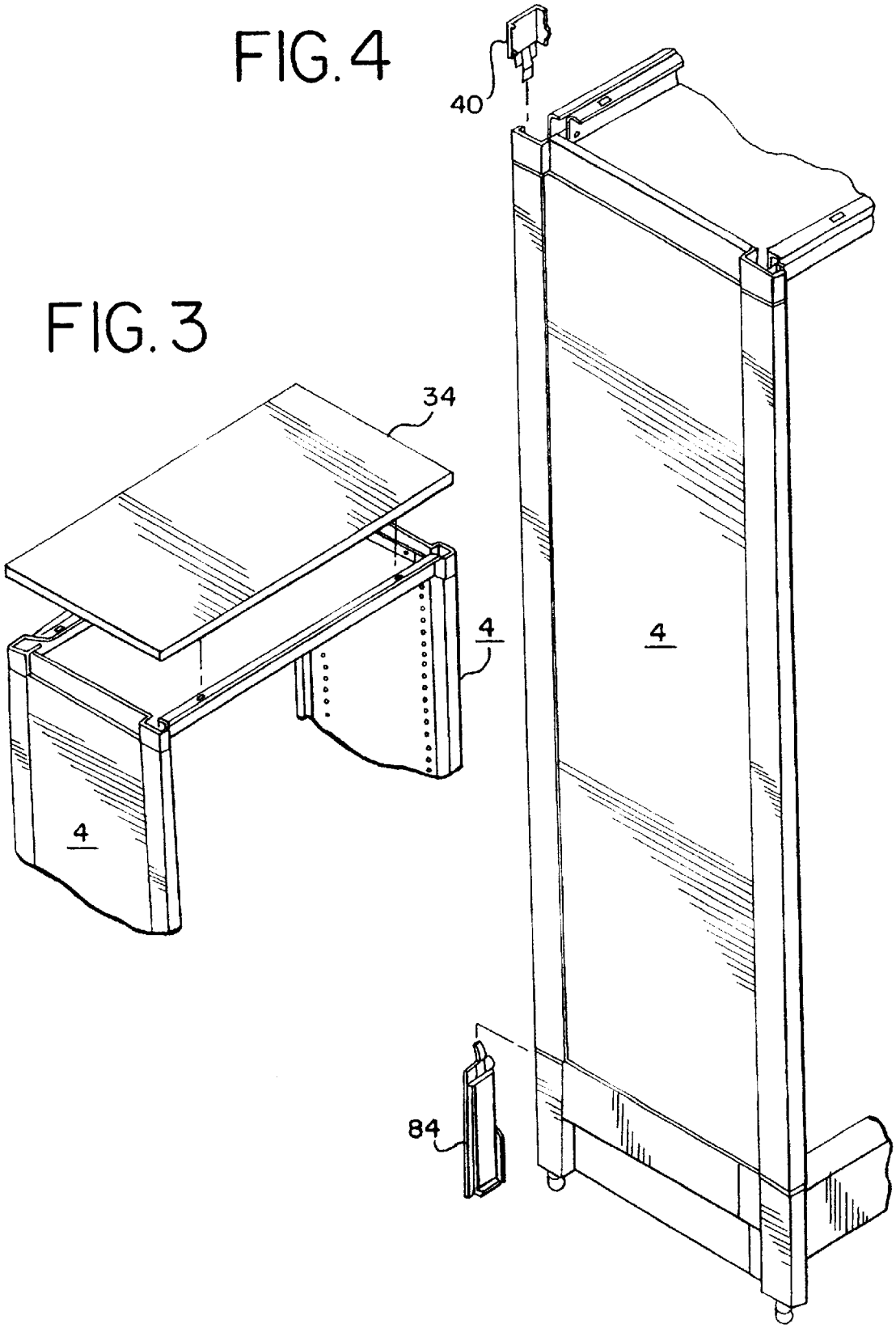
FIGS. 3–7 are exploded views of the embodiment of the cabinet of FIG. 1 and the connector of FIG. 2 to show attachment therebetween.

To begin the process of attaching side wall 4 and panel 86, one first removes top cover 34 of cabinet 2 as shown in FIG. 3. Next pieces 40 and 84 are removed to allow for connector 88 to be attached to the outer wall 14 of side wall 4 as shown in FIG. 5.

Figure 5:
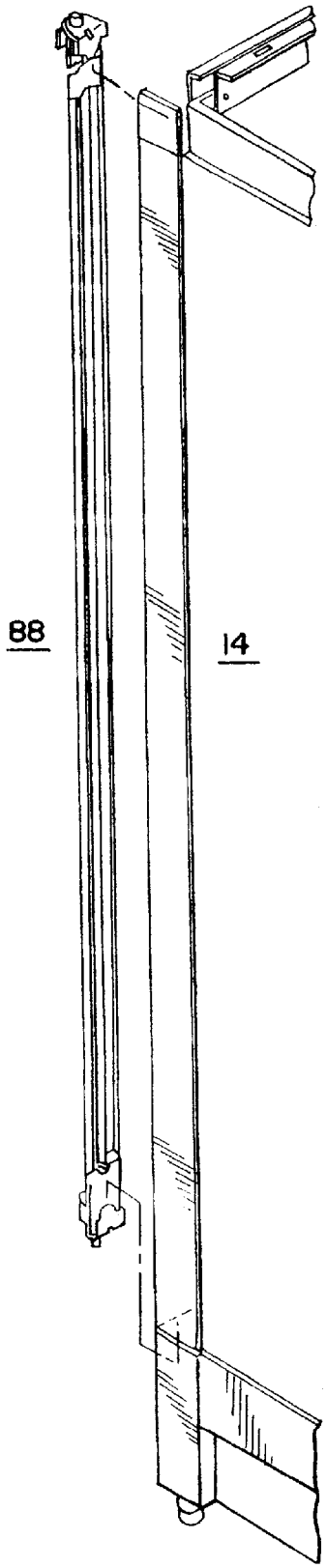

Once assembled as in FIG. 5, connector 88 is attached to panel 86 by having the top and bottom panel mating elements 124, 138 engage with the openings and bases of U-shaped pieces 94, 96, respectively.

Figure 6:
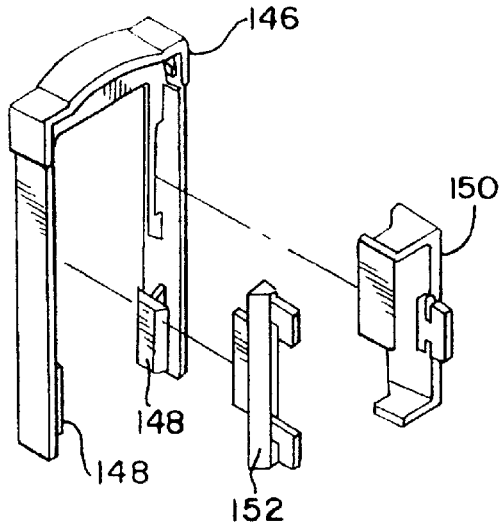
Figure 7:
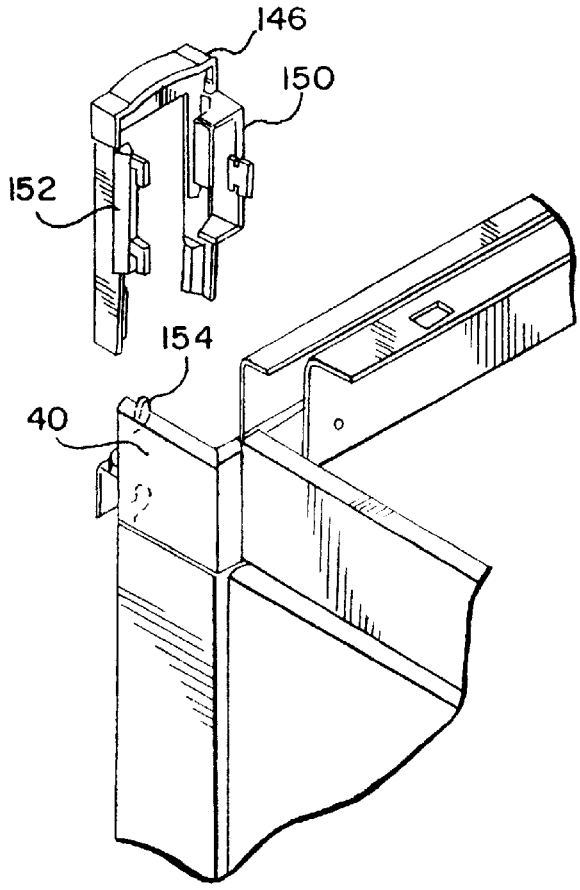

To provide an aesthetically pleasing appearance, U-shaped cover 146 is placed over top support 116. Cover 146 has tabs 148 which engage the base of U-shaped piece 94 to provide a snap-like connection. Cover 146 further includes attachment pieces 150 and 152 which are attached to the sides of cover 146. Attachment piece 152 preferably has downwardly extending tabs to engage upwardly extending tabs 154 of mating piece 40 as shown in FIGS. 6 and 7. In another embodiment shown in FIG. 20, attachment piece 152 is rotated so the tabs extend upwardly to engage tabs 154 should they extend downwardly.

It should be appreciated that other configurations for rod 102, top latch element 114, bottom latch element 128, and the other elements of connector 88 are possible without departing from the spirit of the invention.

Figure 18:
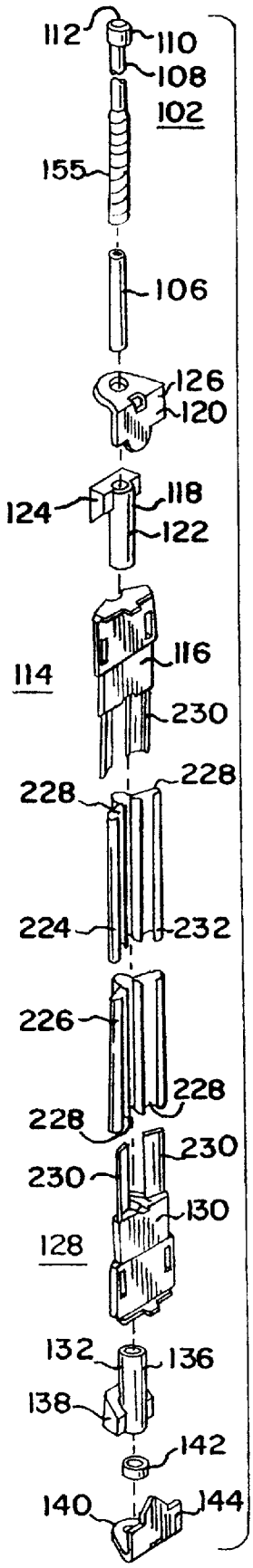
FIG. 18 is an exploded view of a second embodiment of a connector for attachment of a side panel of the embodiment of the cabinet of FIG. 1 with a panel having the same height.

For example, in the embodiment of FIG. 18, connector 88 comprises a connection rod 102 (not to scale) with a plurality of threads 155 including a head 108, stop portion 110 and opening 112. Sleeve cover 224 has a pair of slots 228 that engage a pair of prongs 230 attached to top support 116 and bottom support 130, respectively. The length of sleeve cover 224 is chosen such that when connector 88 is assembled it covers the rod 102. In another embodiment, the single sleeve cover 224 may be replaced with a pair of covers 224, 226 as seen in FIG. 18. As with the embodiment of FIG. 2, the length of sleeve 106 is chosen to approximately match the length of cylindrical section 122. Head 108 includes a stop portion 110 located at the end thereof which preferably has a diameter larger than the remaining portion of head 108. Head 108 further includes an opening 112 to receive a hex driver, such as an allen key.

The connector 88 of FIG. 18 comprises a top latch element 114 having a top support 116, a top panel mating element 118, and a top side wall mating element 120. Top panel mating element 118 preferably has a cylindrical section 122 having an opening to allow the insertion of rod 102 therethrough. A snug fit between rod 102 and the opening of section 122 is accomplished by placing sleeve 106 over that portion of rod 102 which passes through the opening of section 122. Sleeve 106 preferably has a longitudinal slit to allow rod 102 to be easily inserted therein. Top panel mating element 118 fits in a channel in top support 116. Top panel mating element 118 further comprises an engagement piece 124 pointing in a downward direction. Top side wall mating element 120 preferably is attached to the top of support 116 and has an opening to allow the insertion of rod 102 therethrough. Top side wall mating element 120 further comprises an engagement piece 126 pointing in a downward direction and parallel to engagement piece 124. As with the embodiment of FIG. 2, engagement piece 126 is attached to wall 14 by inserting it into a corresponding slot of bracket 90, 92 located in the top of the slot of the wall 14.

Connector 88 also comprises a bottom latch element 128 which comprises a bottom support 130, a bottom panel mating element 132, and a bottom side wall mating element 134. As with top panel mating element 118, bottom panel mating element 132 preferably has a cylindrical section 136 having an opening to allow the insertion of rod 102 therethrough. Likewise, bottom panel mating element 132 fits in a channel in bottom support 130 and has an engagement piece 138 pointing, however, in an upward direction. The rod 102 passes through annular ring 142 that spaces bottom panel mating element 132 away from base 140. Bottom side wall mating element 134 further comprises an engagement piece 144 pointing in an upward direction and parallel to engagement piece 138. As with the embodiment of FIG. 2, engagement piece 144 is attached to wall 14 by inserting it into a corresponding slot of bracket 90, 92 located in the bottom of the slot of the wall 14. Rod 102 is then inserted into the openings of cylindrical sections 122, 136 and top and bottom side wall mating elements 120, 134 and inserted through the opening of base 140 where a nut is then attached to the threads 155.

As described previously, the process of attaching side wall 4 and panel 86 comprises removing top cover 34 of cabinet 2 as shown in FIG. 3. Next pieces 40 and 84 are removed to allow for connector 88 to be attached to the outer wall 14 of side wall 4 as shown in FIG. 5.

Once assembled as in FIG. 5, connector 88 is attached to panel 86 by having the top and bottom panel mating elements 124, 138 engage with the openings and bases of U-shaped pieces 94, 96, respectively.

Figure 20:
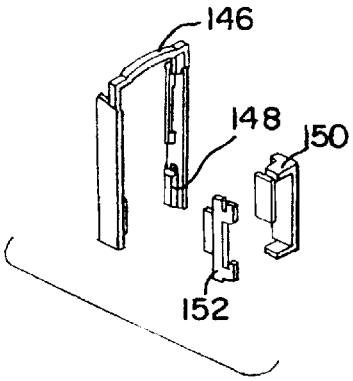
FIG. 20 is an exploded view of an embodiment of a U-shaped cover and attachment pieces to be used with the embodiments of connectors of FIGS. 18–19.

Next the U-shaped cover 146 of FIG. 20 is placed over top support 116. Cover 146 has tabs 148 which engage the base of U-shaped piece 94 to provide a snap-like connection. Cover 146 further includes attachment pieces 150 and 152 which are attached to the sides of cover 146. Attachment piece 152 preferably has upwardly extending tabs to engage downwardly extending tabs 154 of mating piece 40 similar to those shown in FIGS. 6 and 7.

Figure 19:
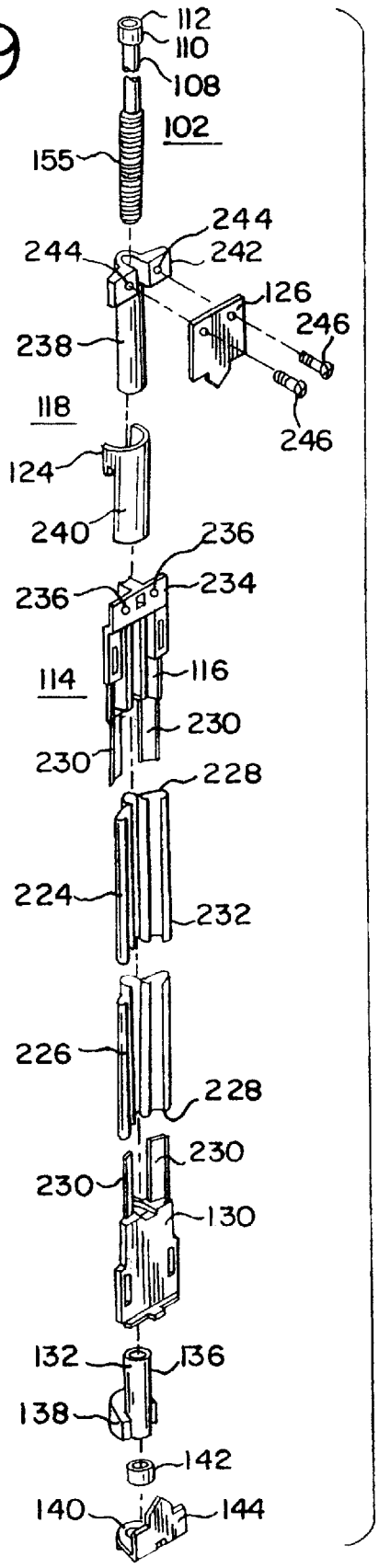
FIG. 19 is an exploded view of a third embodiment of a connector for attachment of a side panel of the embodiment of the cabinet of FIG. 1 with a panel having the same height.

In the embodiment of FIG. 19, connector 88 is similar to the connector 88 of FIG. 18 with several modifications. For example, top support 116 comprises a top bracket 234 having a pair of holes 236. Top support 116 receives top panel mating element 118 which comprises a two attachment components 238, 240. Attachment component 238 comprises a cylindrical section 122 and face 242 having openings 244. Face 242 receives an engagement piece 126 and is attached thereto via screws 246. Cylindrical section 122 has an opening to allow the insertion of rod 102 therethrough. Furthermore, cylindrical section 122 is inserted through attachment component 240 which is half-cylindrical in shape and comprises an engagement piece 124 pointing in a downward direction and parallel to engagement piece 124. It is understood that the connector 88 of FIG. 19 is assembled and attached in a manner similar to that described for the connector 88 of FIG. 18. For example, as with the embodiment of FIG. 2, engagement piece 126 is attached to wall 14 by inserting it into a corresponding slot of bracket 90, 92 located in the top of the slot of the wall 14.

Figure 8:
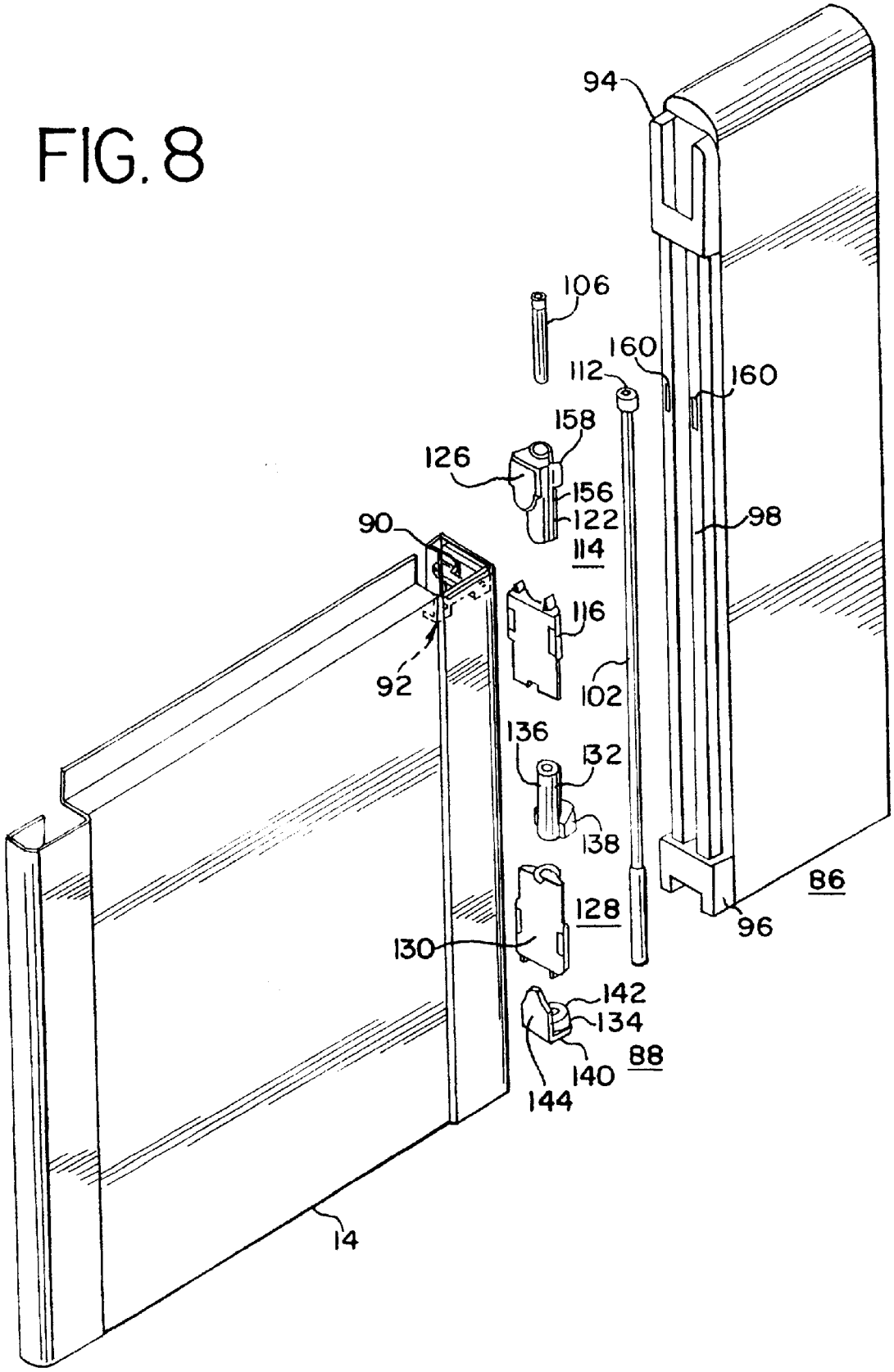
FIG. 8 is an exploded view of an embodiment of a connector for attachment of a side panel of the embodiment of the cabinet of FIG. 1 with a panel having a greater height.

FIG. 8 illustrates the situation where outer wall 14 has a height less than that of panel 86. In that situation, connection is accomplished in a manner similar to that described in the embodiment of FIGS. 2–7. As described previously, connector 88 comprises a top latch element 114 which comprises a top support 116. However, mating assembly 156 performs the functions of top panel mating element 118 and top side wall mating element 120 of the embodiment of FIGS. 2–7. Mating assembly 156 preferably has a cylindrical section 122 having an opening to allow the insertion of connector rod 102 therethrough. Mating assembly 156 fits in top support 116. Mating piece 156 further comprises engagement pieces such as horizontally extending hooks 158. Mating piece 156 further comprises an engagement piece 126 pointing in a downward direction.

Connector 88 comprises a bottom latch element 128 having a bottom support 130, bottom panel mating element 132, and bottom side wall mating element 134 as in the embodiment of FIGS. 2–7. Connector rod 102, with sleeve 106 attached thereto as before, is then inserted into the openings of cylindrical sections 122, 136 and top and bottom side wall mating elements 120, 134. The base 104 of connector rod 102 preferably is inserted into the opening of bottom side wall mating element.

Once assembled, connector 88 is attached by having bottom latch element 128 engage the panel 86 and the bracket 90, 92 of outer wall 14 as in the embodiment of FIGS. 2–7. Furthermore, engagement piece 126 engages outer wall 14 as described previously. However, further engagement with panel 86 is obtained by inserting hooks 158 into corresponding openings 160 located on columns 98. It should be appreciated that other configurations for rod 102, top latch element 114, bottom latch element 128, and the other elements of connector 88 are possible without departing from the spirit of the invention.

Figure 9:
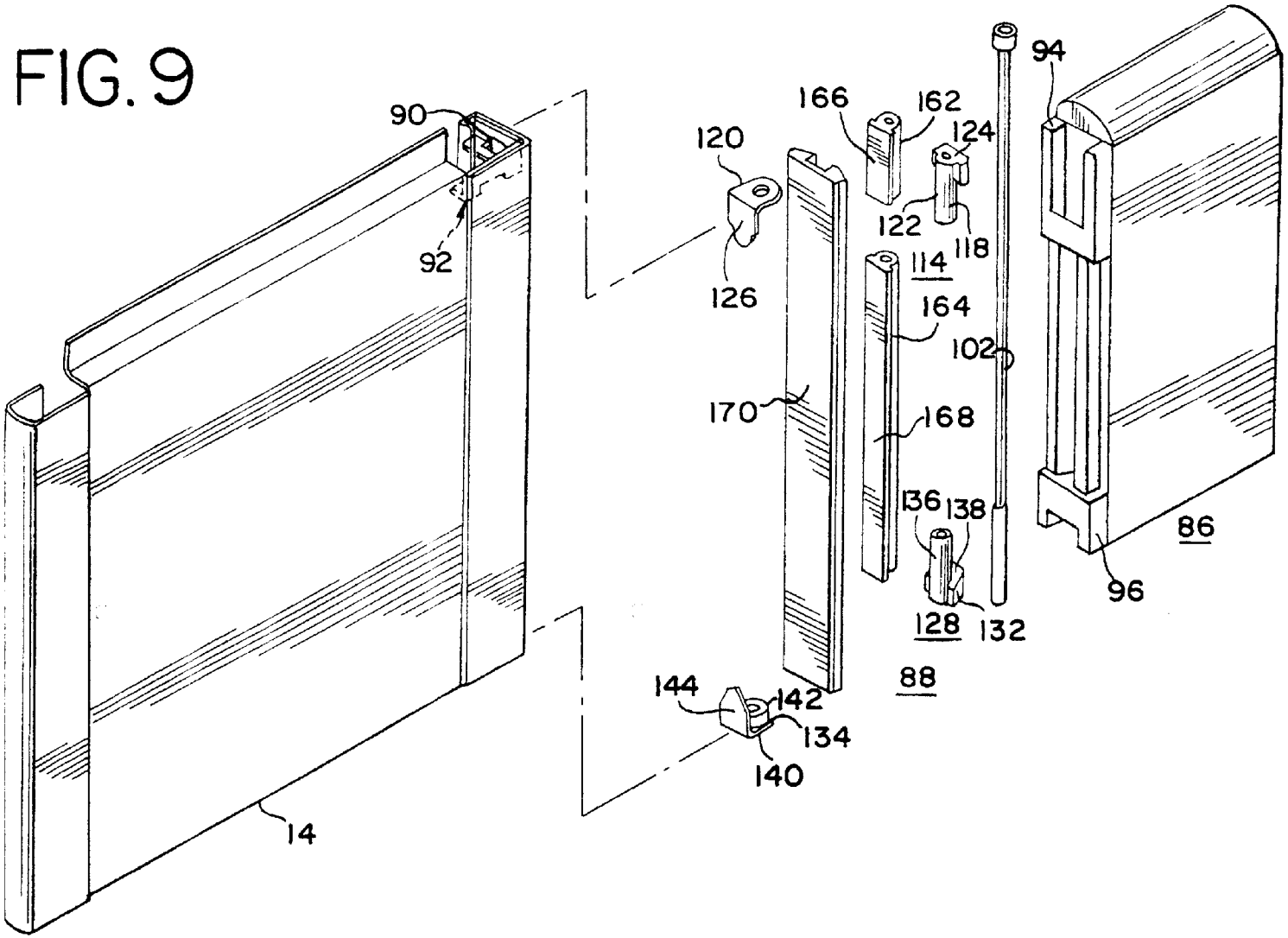
FIG. 9 is an exploded view of a n embodiment of a connector for attachment of a side panel of the embodiment of the cabinet of FIG. 1 with a panel having a lesser height.

FIG. 9 illustrates the situation where outer wall 14 has a height greater than that of panel 86. Connector 88 comprises top panel mating element 118 and top side wall mating element 120. Top panel mating element 118 of top latch element 114 is located between connector guides 162 and 164 which are slidably attached via planar guides 166 and 168, respectively, to a channel located in support 170. Top panel mating element 118 further comprises an engagement piece 124 pointing in a downward direction. Top side wall mating element 120 preferably is attached to the top of support 170 and has an opening to allow the insertion of connector rod 102 therethrough. Top side wall mating element 120 further comprises an engagement piece 126 pointing in a downward direction and parallel to engagement piece 124.

Connector 88 further comprises a bottom latch element 128 which comprises a bottom support 136, a bottom panel mating element 132, and a bottom side wall mating element 134. Bottom latch element 128 preferably is located directly below support 170. As with top panel mating element 118, bottom panel mating element 132 preferably has a cylindrical section 136 having an opening to allow the insertion of connector rod 102 therethrough.

Bottom side wall mating element 134 preferably is attached to the bottom of support 170 and has a base 140 to allow connector rod 102 to be supported thereon. An opening such as annular ring 142 is attached to base 140 to allow connector rod 102 to be inserted therein and fix the rod 102 in place. Bottom side wall mating element 134 further comprises an engagement piece 144 pointing in an upward direction and parallel to engagement piece 138.

Connector rod 102, with sleeve 106 (not shown), is then inserted into the openings of cylindrical sections 122, 136, connector guides 162, 164 and top and bottom side wall mating elements 120, 134. The base 104 of connector rod 102 preferably is inserted into the opening of bottom side wall mating element 134.

Once assembled as in FIG. 9, connector 88 is attached to panel 86 by having the top and bottom panel mating elements 124, 138 engage with the openings and bases of U-shaped pieces 94, 96, respectively, as in the FIG. 2 embodiment. Support 170 is attached to outer wall 14 via top and bottom engagement pieces 126 and 144 engaging brackets 90, 92 located at the top and bottom of the slot of outer wall 14. It should be appreciated that other configurations for rod 102, top latch element 114, bottom latch element 128, and the other elements of connector 88 are possible without departing from the spirit of the invention.

For example, connector 88 can be modified as shown by the embodiment of FIG. 21 where rod 102 is inserted through an opening in top side wall element 120 and through connector guide 162. In addition, a sleeve 248 is inserted through connector guide 164 and cylindrical section 122 of top panel mating element 118. Finally, cylindrical section 136 is adjacent to connector guide 164. Connection between the pieces is accomplished by inserting rod 102 through guides 162, 164, cylindrical sections 122, 136 and an opening in base 140. A nut is attached to the threaded portion 155 extending through the opening of base 140.

In the above-described embodiments of FIGS. 2–9 and 18–21, attachment of a panel 86 aligned with side wall 4 of cabinet 2 is possible. As shown in FIGS. 10–14 and 22–23, it is also possible to attach a panel 86 to outer wall 14 which are oriented at a 90° angle with respect to each other.

Figure 10:
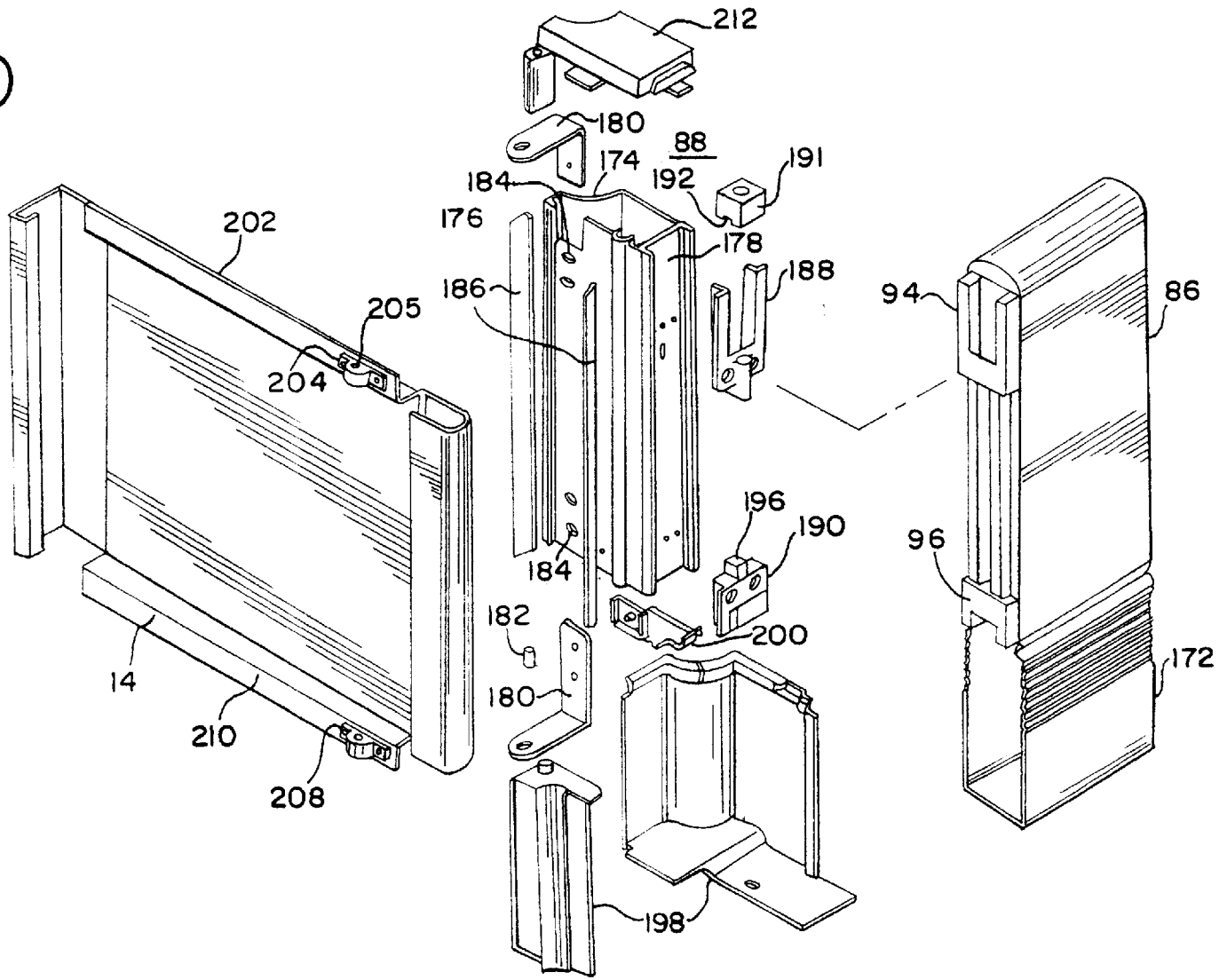
FIG. 10 is an exploded view of a n embodiment of a connector for attachment of a side panel of the embodiment of the cabinet of FIG. 1 with a panel oriented at a 90° angle.

As in the embodiment of FIG. 10, outer wall 14 of side wall 4 comprises two vertical slotted areas. Furthermore, panel 86 is located above a skirt 172 and comprises two U-shaped pieces 94 and 96 as described before in the embodiment of FIG. 2. Connection between panel 86 and side wall 4 is accomplished by a connector 88.

Connector 88 comprises a connection piece 174 having a side wall attachment surface 176 and a panel attachment surface 178 which are oriented at 90° with respect to each other. Side wall connectors 180, such as right-angled brackets, are attached to attachment surface 176 by means of attachment devices 182, such as screws or nuts and bolts, that are inserted into openings 184 present on attachment surface 176. Brackets 186 are attached in a well known manner along the vertical edges of attachment surface 176 to provide a trim to cover the openings formed by connector 88, outer wall 14, and panel 86.

Similarly, panel attachment surface 178 comprises top and bottom panel connectors 188, 190, respectively, located near the top and bottom of surface 178. In one embodiment, top panel connector 188 has a U-shape and is connected to surface 178 by well known means, such as nuts and bolts. In the channel of the U-shaped connector 188 an engagement piece 191 is inserted. Engagement piece 191 comprises a threaded opening which is aligned with another threaded opening on connector 188. Attachment between engagement piece 191 and connector 188 is accomplished by inserting a threaded bolt or screw into the aligned openings of connector 188 and engagement piece 191. Engagement piece 191 comprises a seat 192 such that engagement piece 191 rests on the bottom of the channel of connector 188. Engagement piece 191 is compressively secured to connector 188 when connector 188 is pressed against attachment surface 178 upon attachment thereto. When properly secured, engagement piece 191 has an engagement portion 194 which extends beyond connector 188 (See FIG. 11).

Bottom panel connector 190 is attached to surface 178 by well known means, such as nuts and bolts. Connector 190 comprises an engagement portion 196 which extends in an upward direction from the connector 190.

Once assembled, connector 190 is attached to a connector skirt 198 via an attachment device 200, such as a bracket wherein attachment is achieved by the use of such well known means as nuts and bolts. Connector skirt 198 comprises one or more pieces to give the desired aesthetic look.

Figure 12:
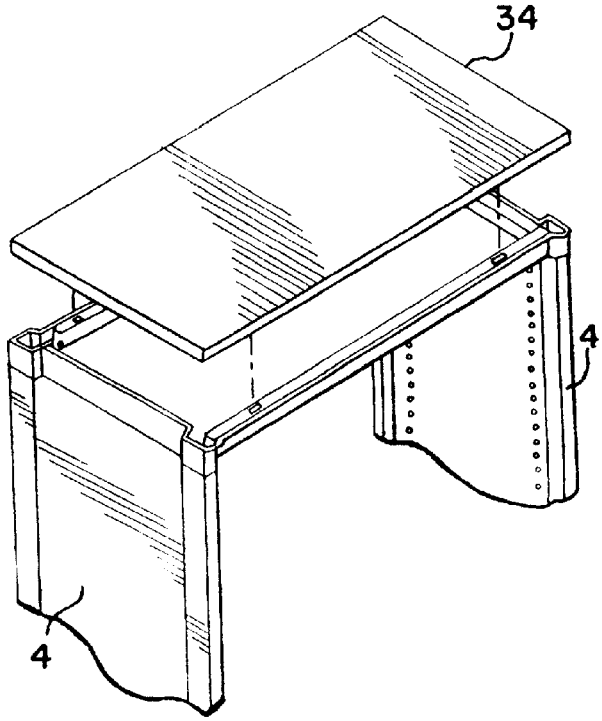
Figure 13:
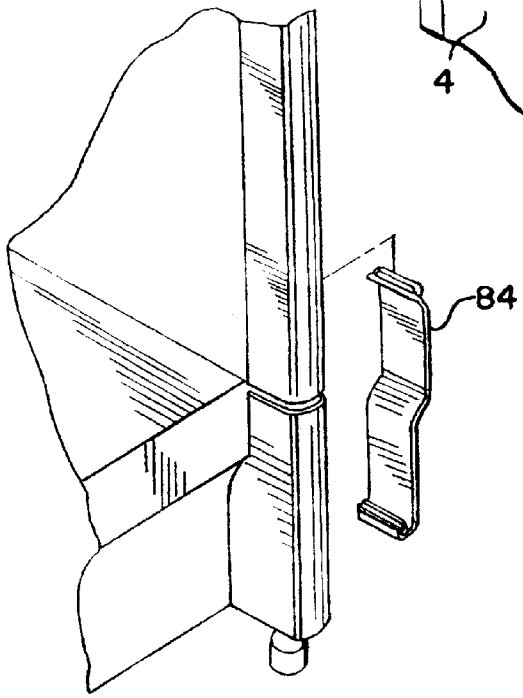

Attachment of side wall 4 to panel 86 is accomplished by first removing top cover 34 as shown in FIG. 12. Next, trim extensions 84 are removed to allow for connector 88 to be attached to the outer wall 14 of side wall 4 as shown in FIG. 13. Connector 88 is attached to a top bracket 202 which has a top attachment device 204 attached thereto in a well known manner, such as nuts and bolts. Top attachment device 204 has a vertical opening 205. Connector 88 is connected by aligning the openings of the top bracket 180 with the opening of top attachment device 204 and inserting a bolt therethrough which is attached by a nut 206, as shown in FIG. 14.

Figure 14:
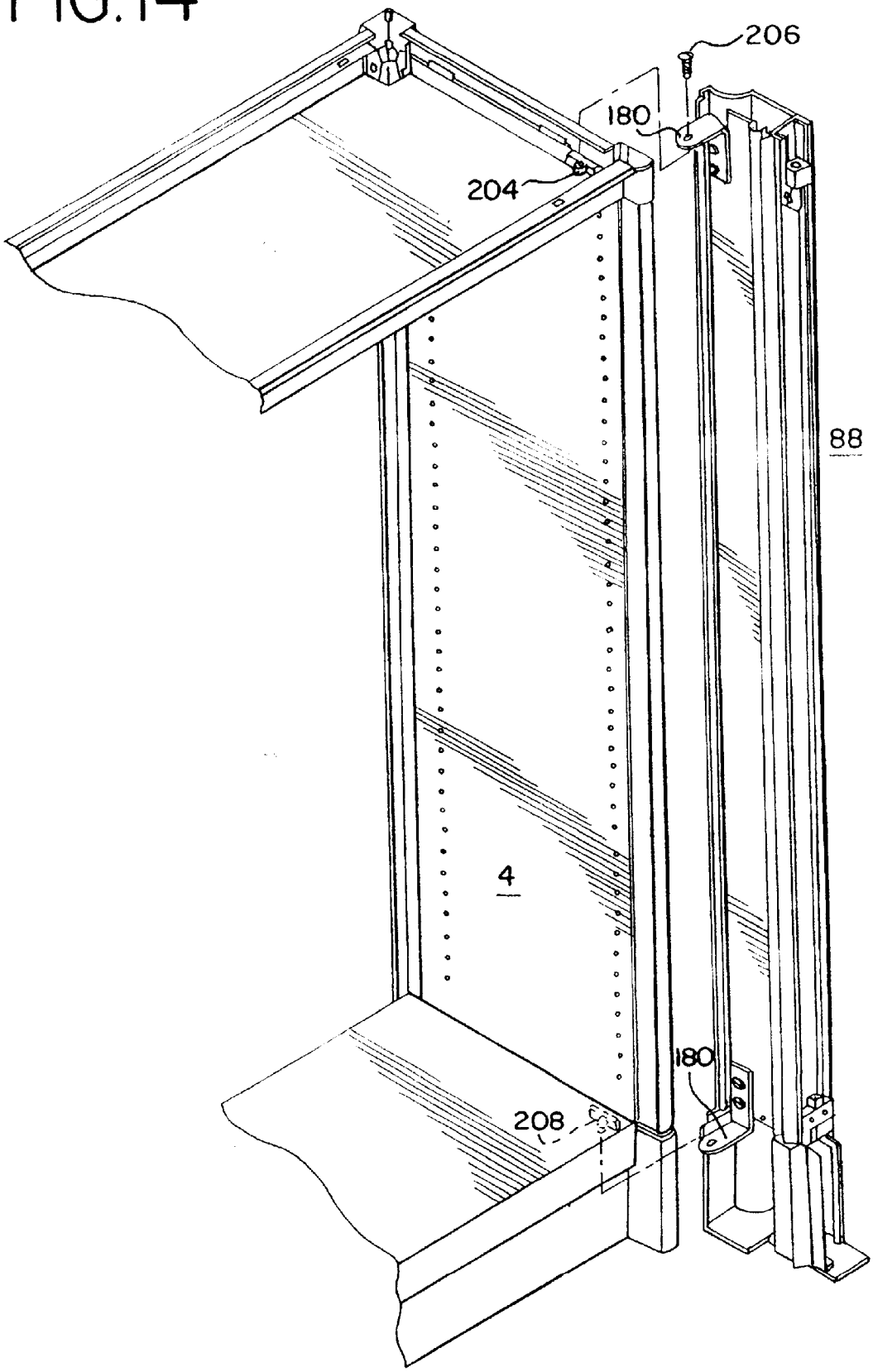

Attachment is accomplished in a similar manner for the bottom parts of connector 88 and outer wall by bottom attachment device 208 (connected to bracket 210 of outer wall 14) and bottom bracket 180, as shown in FIG. 14.

Figure 11:
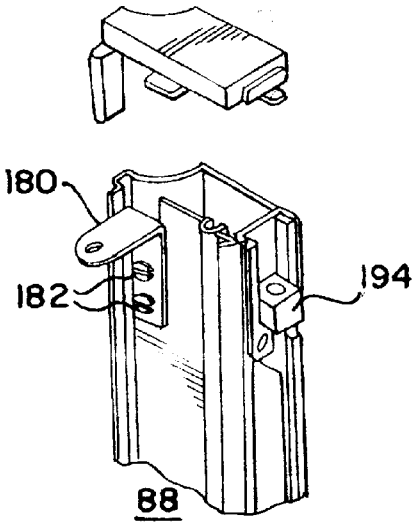
FIGS. 11–14 are exploded views of the embodiment of the cabinet of FIG. 1 and the connector of FIG. 10 to show attachment therebetween.

Panel 86 is attached to connector 88 by having engagement portions 194 and 196 engage the openings and bases of U-shaped pieces 94, 96, respectively, in a manner similar to the-attachment of top and bottom mating elements 124 and 138 to U-shaped pieces 94, 96 as shown in FIGS. 2–9. To provide an aesthetically pleasing appearance, cap 212 is placed over and pressed into the top opening formed by connector 88 as shown in FIGS. 10 and 11.

Figure 22:
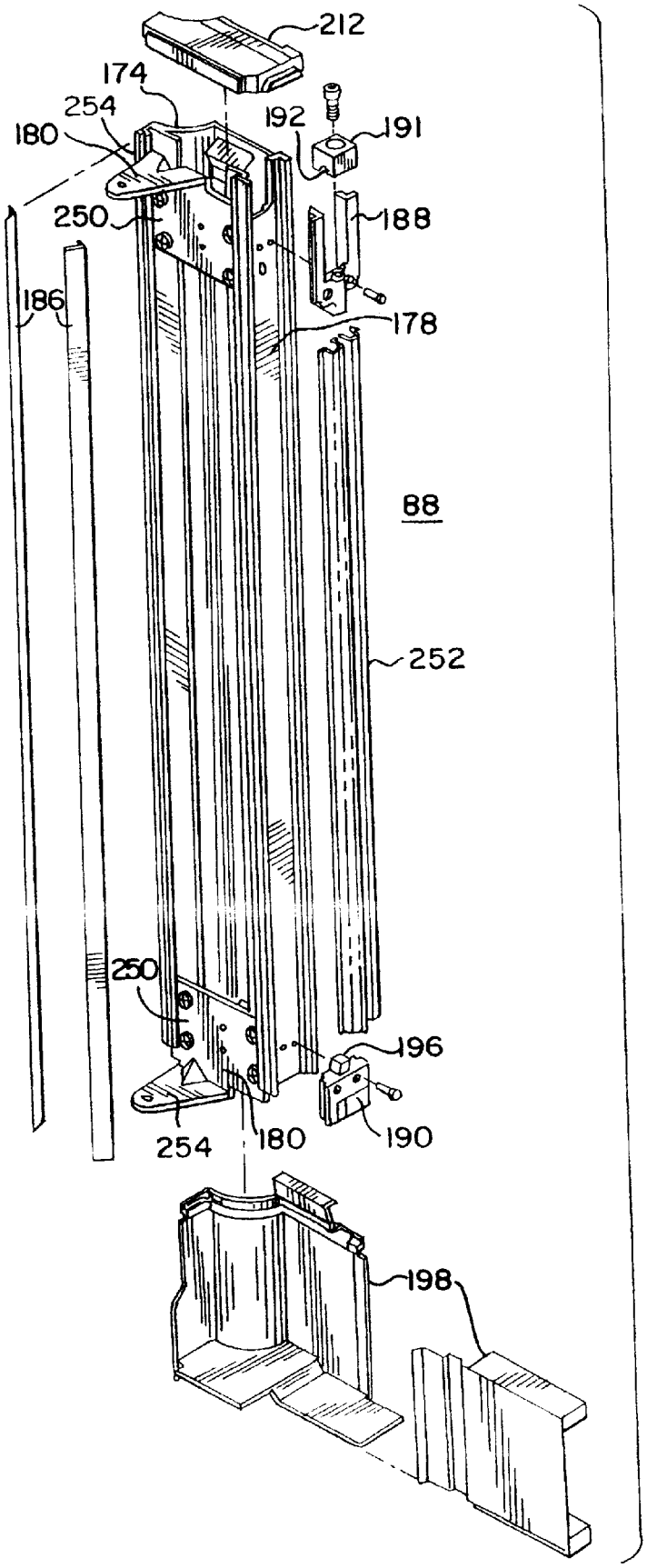
FIG. 22 is an exploded view of a second embodiment of a connector for attachment of a side panel of the embodiment of the cabinet of FIG. 1 with a panel oriented at a 90° angle.

A variation of the connector 88 of FIG. 10 is shown in FIG. 22. As can be seen, the differences between the two embodiments involves the use of a wider rectangular piece 250 for top and bottom brackets 180 that extends across the width of connection piece 174 and is used for attaching brackets 180 to connection piece 174. Another difference between the two connectors 88 is that a cover 252 is attached to panel attachment surface 178 and extends between panel connectors 188 and 190. Finally, the attachment piece 254 of side wall connectors 180 of FIG. 22 have a triangular-like shape versus the rectangular-like shape of the connectors 180 of FIG. 10.

Figure 16:
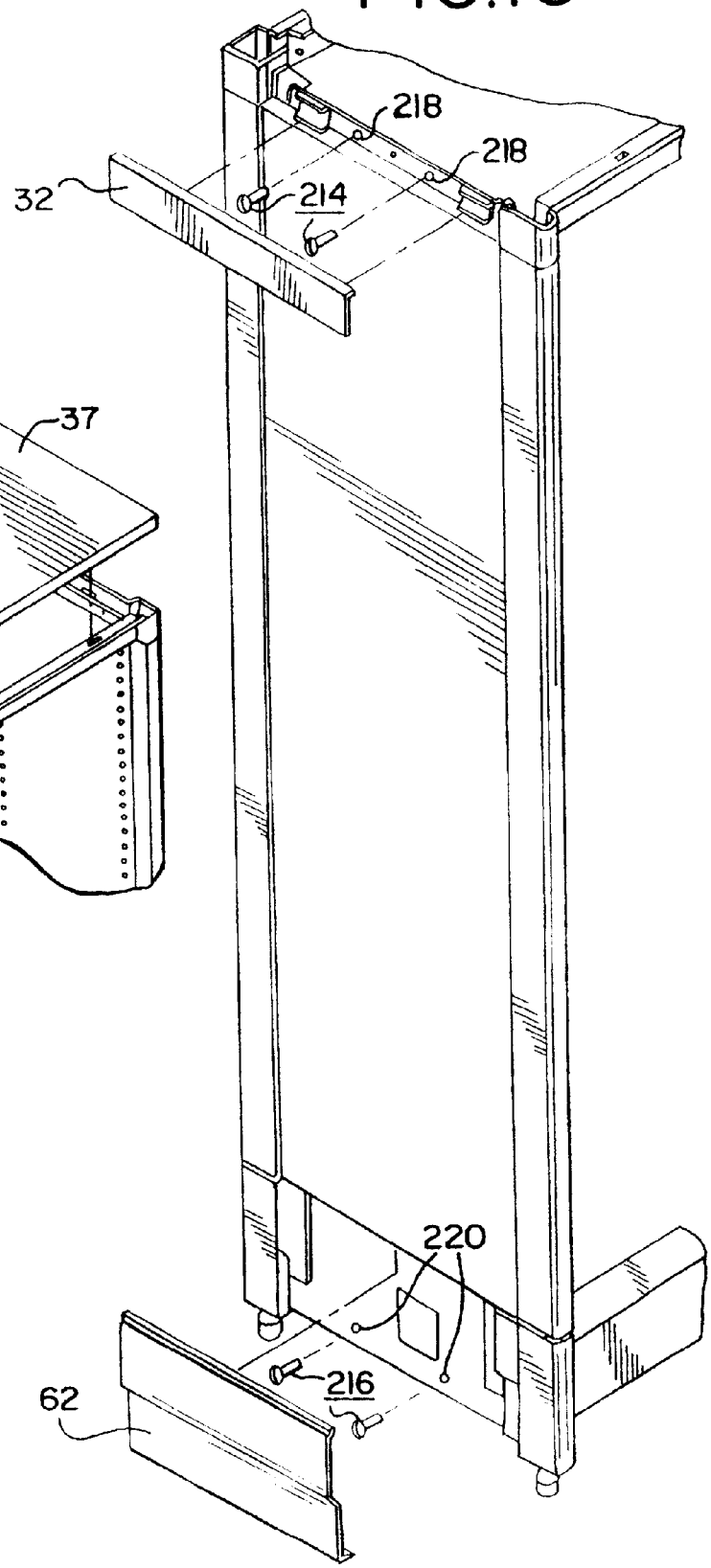
FIGS. 15–17 are exploded views of an embodiment of a connector for side-by-side attachment of two cabinets according to the embodiment of FIG. 1.
Figure 15:
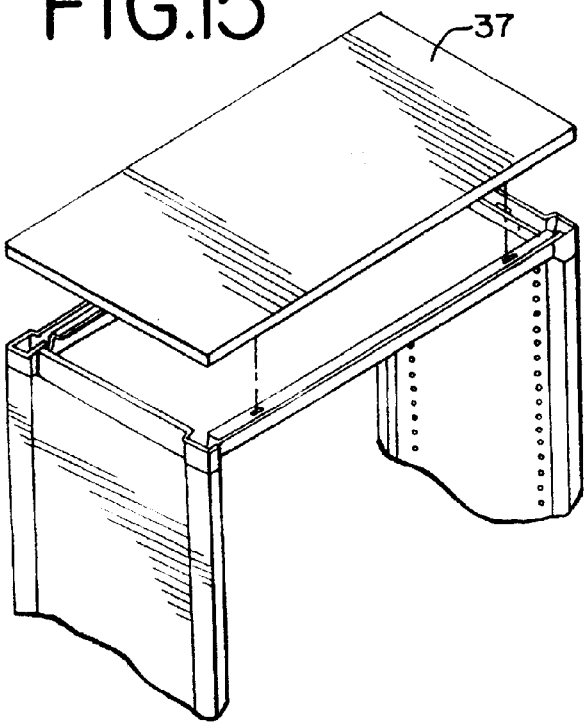

The above-described cabinet may also be attached to one or more cabinets either side to side or back to back. In both types of attachments, the first step is to remove top cover 37, as shown in FIG. 15. When it is desired to attach two cabinets side-to-side according to the present invention, it is necessary to remove on each of the cabinets the bottom covers 62 corresponding to the sides to be attached. It is also necessary to remove the lateral sides 32, as shown in FIG. 16. Once items 32, 37, and 37 are removed, one or more top bolts 214 and bottom bolts 216 are attached to corresponding top holes 218 and bottom holes 220 present in each cabinet. In another embodiment, each bolt 214, 216 is inserted through a separator 270 positioned between the attached sides of the cabinets. Washers 272 may be used to assist connection by attaching nut 274. A similar procedure is performed for back-to-back attachment.

Figure 23:
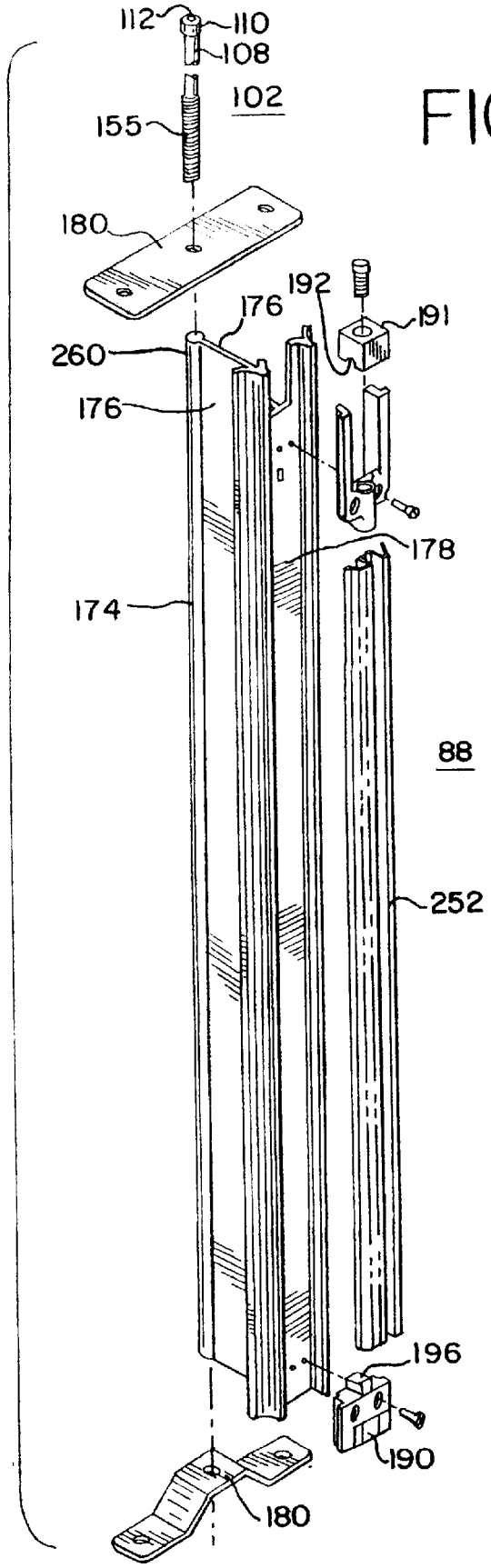
FIG. 23 is an exploded view of an embodiment of a connector for attachment of a side panel of a first cabinet according to the embodiment of FIG. 1 with a side panel of a second cabinet of the cabinet of FIG. 1 and oriented parallel to the side panel of the first cabinet.

It is also possible to attach two cabinets side-to-side along with a panel aligned with the space formed between the two cabinets. Attachment is accomplished by using a connector 88 similar to the one shown in FIG. 14, but where there are also a second set of brackets 180 to engage a side of the second cabinet. The panel is connected in the same fashion as described with the embodiment of FIG. 14. Examples of such a connector is shown in FIG. 23. In FIG. 23, connector 88 comprises a connection piece 174 having a pair of side wall attachment surfaces 176 and a panel attachment surface 178 which bisected by and is oriented at 90° with respect to attachment surfaces 178. Side wall attachment surfaces 176 and attachment surface 178 may be integrally formed together or be separate pieces that are connected to each other in a well known manner. Top and bottom side wall connectors 180 are provided to attach the side walls of adjacent cabinets together. Top connector 180 preferably is flat while bottom connector 180 is elevated in the middle. Each connector 180 is attached to surfaces 176 in a well known manner such as by a threaded rod 102 that extends through middle openings of connectors 180 and a cylindrical mount 260. A nut is attached to the threaded portion of rod 102 extending through the bottom connector 180.

The attachment of the panel is accomplished by a structure similar to that shown in FIGS. 10–14 with panel attachment surface 178 comprising top and bottom panel connectors 188, 190, respectively, located near the top and bottom of surface 178 and a cover 252 therebetween. Attachment of a panel is accomplished in the same manner as described for FIGS. 10–14. Furthermore, attachment of the side walls is accomplished in a manner similar to that described for FIGS. 10–14. The only difference being that the connectors 180 in the embodiment of FIGS. 10–14 is only capable of being attached to one side wall, while the connector of FIG. 23 has holes at both ends, each to be attached to a side wall in the manner described for the embodiment of FIGS. 10–14.

Another embodiment of connector 88 is shown in FIG. 24 that allows for two sides of a cabinet to be attached to each other. Connector 88 is in the shape of a cover having a groove 258. L-shaped brackets 264 are mounted within the groove 258 and are located near the top and bottom of connector 88. Each bracket 264 has a connector 180 attached thereto by nut 266 and bolt 268 that corresponds to the connectors of the embodiment of FIG. 23. In another embodiment, each bracket 264 is attached to a separate inner sleeve that is attached within groove 258. Attachment of the walls of the cabinets is accomplished much in the same manner as described for the embodiment of FIG. 23.

Figure 17:
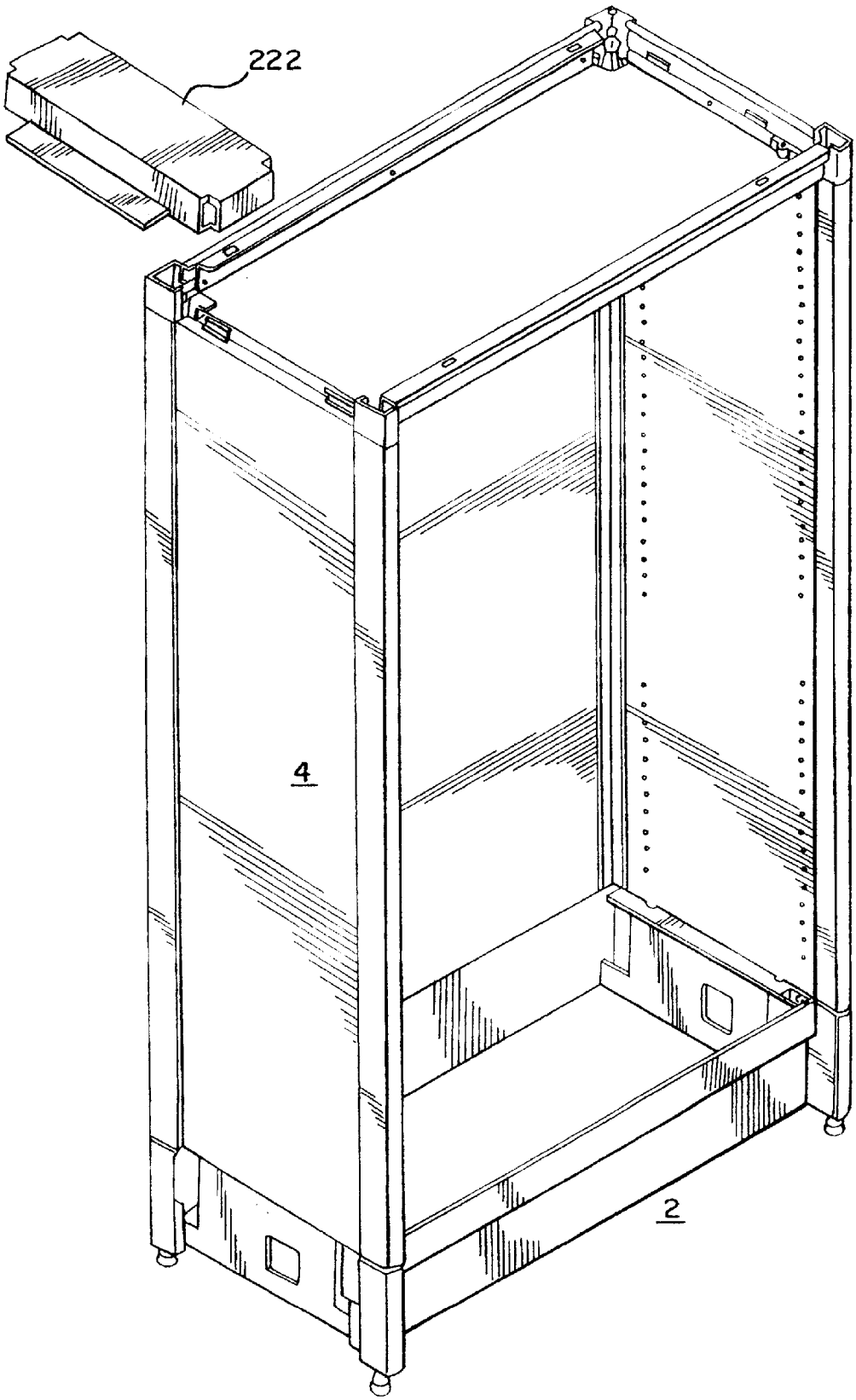
Figure 25:
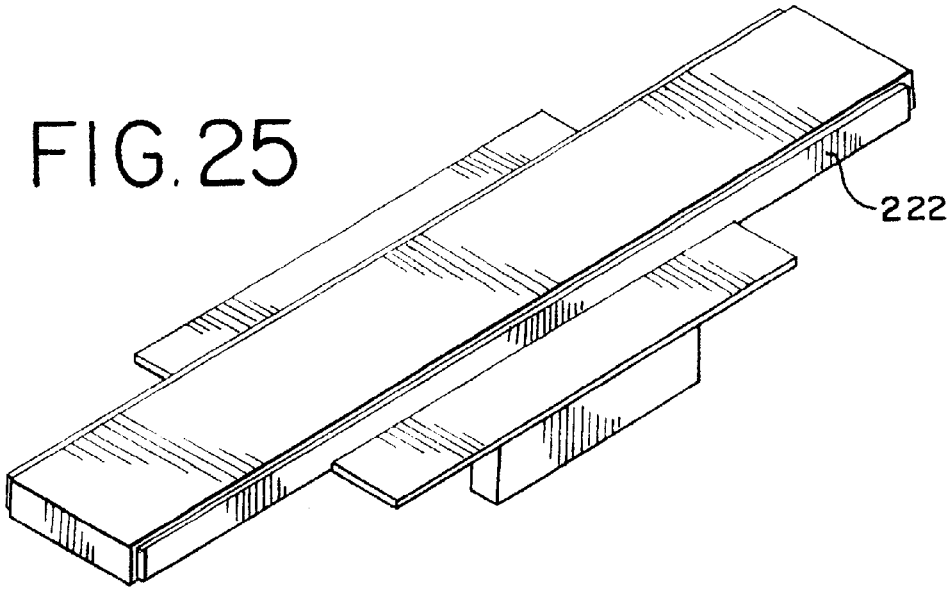
FIG. 25 is a second embodiment of a cover to be placed over a space defined between adjacent cabinets.
Figure 26:
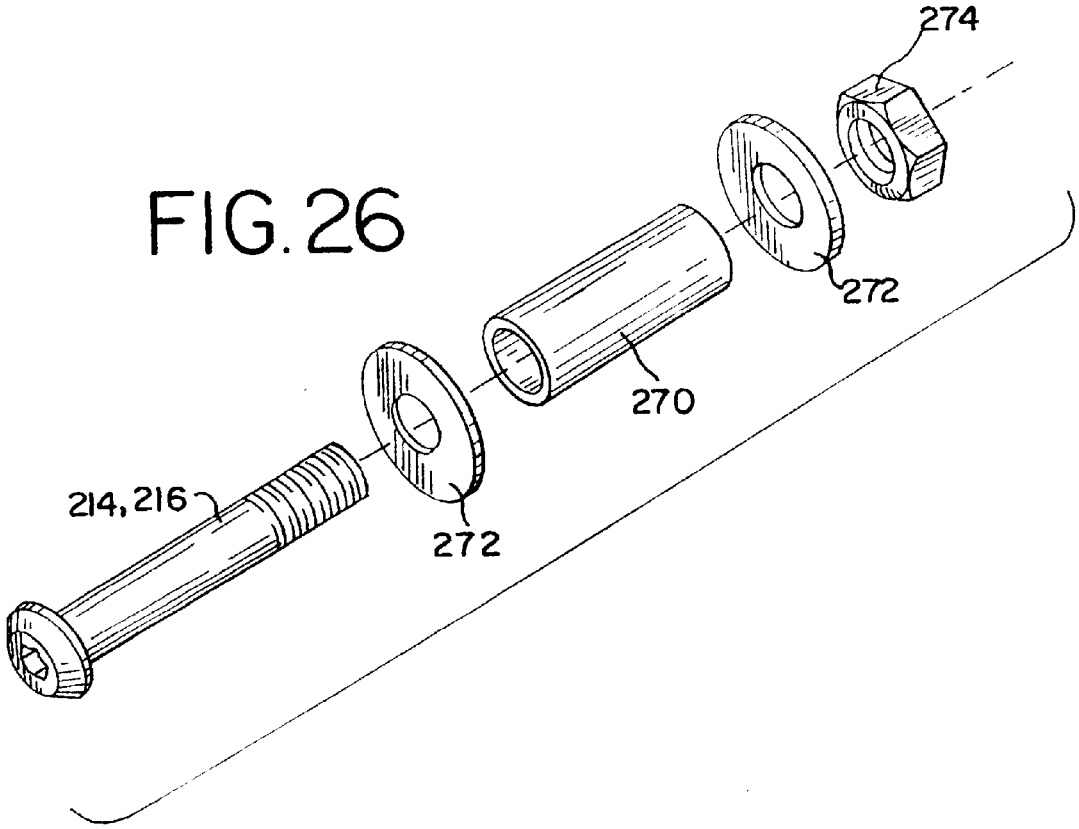
FIG. 26 is an embodiment of an attachment device for attaching adjacent cabinets according to the embodiment of FIG. 1.

In both of the embodiments of FIGS. 23 and 24, when the cabinets and the panel are connected to each other a space is present between the cabinets. To cover this space from above, a top cover 222, such as shown in either FIG. 17 or FIG. 25, is attached to both cabinets in a well known manner and the cover 222 is positioned to conceal the space as one looks at both cabinets from above.

The foregoing description is provided to illustrate the invention, and is not to be construed as a limitation. Numerous additions, substitutions and other changes can be made to the invention without departing from its scope as set forth in the appended claims.

We claim:

1. A cabinet comprising:

a top piece;

a bottom piece;

a wall attached to said top piece and said bottom piece, wherein said wall comprises:

an inner wall;

an outer wall attached to said inner wall, wherein said inner wall and said outer wall define a cavity;

a first unitary strengthening element which has a unitary structure independent of said inner wall and said outer wall, said first unitary strengthening element having a first pattern of apertures facing said inner and outer walls and positioned between said inner wall and said outer wall in said cavity having a thickness so as to contact said inner wall and said outer wall, wherein said first pattern of apertures comprises a plurality of interconnected columns having two or more vertically aligned apertures and no two abutting apertures of adjacent columns form a horizontal row; and a second unitary strengthening element which has a unitary structure independent of said inner wall and said outer wall, said second unitary strengthening element having a second pattern of apertures facing said inner and outer walls, said second strengthening element being separated from said first strengthening element by a volume of space, said second strengthening element substantially coplanar with said first strengthening element and positioned between said inner wall and said outer wall in said cavity having a thickness so as to contact said inner wall and said outer wall, wherein said second pattern of apertures comprises a plurality of interconnected columns having two or more vertically aligned apertures and no two abutting apertures of adjacent columns form a horizontal row;

wherein said volume of space has a width that extends between said first and second strengthening elements and said volume of space is devoid of any materials that strengthen said wall.

2. The cabinet of claim 1, wherein said structure of each of said first and second strengthening elements comprises a regular pattern of their respective apertures.

3. The cabinet of claim 1, wherein said first and second strengthening elements each has a honeycomb structure.

4. The cabinet of claim 3, wherein said respective apertures of each of said first and second strengthening elements face said inner and outer walls.

5. The cabinet of claim 3, wherein said first and second strengthening elements are attached to said inner wall and said outer wall.

6. The cabinet of claim 1, wherein said first strengthening element comprises paper.

7. The cabinet of claim 1, wherein said first strengthening element comprises paper.

8. The cabinet of claim 1, wherein each of said apertures of each of said first and second strengthening elements comprises a hexagon.

9. The cabinet of claim 8, wherein said hexagon is a regular hexagon.

10. The cabinet of claim 8, wherein said hexagon comprises a pair of sides parallel to an edge of said wall.

11. The cabinet of claim 1, wherein said wall has a strength such that said wall does not require a frame for support.

12. The cabinet of claim 1, wherein said volume of space is greater than the combined volume of said strengthening elements and said apertures.

13. The cabinet of claim 1, wherein abutting apertures of adjacent columns are vertically offset from one another.

14. The cabinet of claim 13, wherein abutting apertures of adjacent columns form a plurality of rows that form an acute angle with the adjacent columns.

15. The cabinet of claim 1, wherein abutting apertures of adjacent columns form a plurality of rows that form an acute angle with the adjacent columns.

16. A cabinet comprising:

a top piece;

a bottom piece;

a wall attached to said top piece and said bottom piece, wherein said wall comprises:

a first wall;

a second wall attached to said first wall, wherein said first wall and said second wall define a cavity;

a first unitary strengthening element which has a unitary structure independent of said first wall and said second wall, said first unitary strengthening element having a first pattern of apertures facing said inner and outer walls and positioned between and attached to said first wall and said second wall in said cavity, wherein said first strengthening element is symmetrically positioned about a first plane of symmetry of said first wall, wherein said first pattern of apertures comprises a plurality of interconnected columns having two or more vertically aligned apertures and no two abutting apertures of adjacent columns form a horizontal row; and a second unitary strengthening element which has a unitary structure independent of said first wall and said second wall, said second unitary strengthening element having a second pattern of apertures facing said inner and outer walls, said second strengthening element being separated from said first strengthening element by a volume of space, said second strengthening element substantially coplanar with said first strengthening element and positioned between said first wall and said second wall in said cavity, wherein said second pattern of apertures comprises a plurality of interconnected columns having two or more vertically aligned apertures and no two abutting apertures of adjacent columns form a horizontal row;

wherein said volume of space has a width that extends between said first and second strengthening elements and said volume of space is devoid of any materials that strengthen said wall.

17. The cabinet of claim 16, wherein said first and second strengthening elements are symmetrically positioned about a second plane of symmetry of said first wall.

18. The cabinet of claim 17, wherein said first and second planes of symmetry are perpendicular to each other.

19. The cabinet of claim 16, wherein said second strengthening element is symmetrically positioned about said first plane of symmetry of said first wall.

20. The cabinet of claim 19, wherein said first strengthening element and said second strengthening material are symmetrically spaced from each other with respect to a second plane of symmetry of said first wall.

21. The cabinet of claim 18, wherein said first and second planes of symmetry are perpendicular to each other.

22. The cabinet of claim 16, wherein said wall has a strength such that said wall does not require a frame for support.

23. The cabinet of claim 16, wherein said structure of each of said first and second strengthening elements comprises a regular pattern of their respective apertures.

24. The cabinet of claim 16, wherein said first and second strengthening elements each has a honeycomb structure.

25. The cabinet of claim 24, wherein said one or more apertures of each of said first and second strengthening elements face said first and second walls.

26. The cabinet of claim 16, wherein said volume of space is greater than the combined volume of said strengthening elements and said apertures.

27. The cabinet of claim 16, wherein abutting apertures of adjacent columns are vertically offset from one another.

28. The cabinet of claim 1, wherein abutting apertures of adjacent columns are vertically offset from one another.

29. The cabinet of claim 28, wherein abutting apertures of adjacent columns form a plurality of rows that form an acute angle with the adjacent columns.

30. The cabinet of claim 16, wherein abutting apertures of adjacent columns form a plurality of rows that form an acute angle with the adjacent columns.

31. The cabinet of claim 27, wherein abutting apertures of adjacent columns form a plurality of rows that form an acute angle with the adjacent columns.

32. A cabinet comprising:

a top piece;

a bottom piece;

a first wall, a second wall, and a third wall, each having a plurality of edges and attached to said top piece and said bottom piece, wherein one of said first, second, and third walls comprises:

an inner wall;

an outer wall attached to said inner wall, wherein said inner wall and said outer wall define a cavity having a boundary defined by said plurality of edges of said one of said first, second and third walls;

a strengthening element having a pattern of apertures facing said inner and outer walls and positioned between said inner wall and said outer wall in said cavity and having a thickness so as to contact said inner wall and said outer wall, wherein said pattern of apertures comprises a plurality of interconnected columns having two or more vertically aligned apertures and no two abutting apertures of adjacent columns form a horizontal row, wherein a volume of space, exclusive of said strengthening element and said apertures, is defined, where the cavity consists essentially of said volume of space, said strengthening element and said apertures; and wherein said volume of space is devoid of any materials that strengthen said one of said first, second and third walls and said volume of space is greater than the combined volume of said strengthening element and said apertures.

33. The cabinet of claim 32, wherein said strengthening element comprises a regular pattern of said apertures.

34. The cabinet of claim 33, wherein said strengthening element has a honeycomb structure.

35. The cabinet of claim 34, wherein said strengthening element is attached to said inner wall and said outer wall.

36. The cabinet of claim 32, wherein said strengthening element comprises paper.

37. The cabinet of claim 32, wherein each of said apertures comprises a hexagon.

38. The cabinet of claim 37, wherein said hexagon is a regular hexagon.

39. The cabinet of claim 38, wherein said hexagon comprises a pair of sides parallel to one of said plurality of edges of said one of said first, second and third walls.

40. The cabinet of claim 32, wherein said wall has a strength such that said one of said first, second and third walls does not require a frame for support.

41. The cabinet of claim 32, wherein said one of said first, second and third walls is the first wall and said strengthening element is symmetrically positioned about a first plane of symmetry of said first wall.

42. The cabinet of claim 41, wherein said strengthening element is symmetrically positioned about a second plane of symmetry of said first wall.

43. The cabinet of claim 42, wherein said first and second planes of symmetry are perpendicular to each other.

44. The cabinet of claim 41, wherein said first wall has a strength such that said first wall does not require a frame for support.

45. The cabinet of claim 41, wherein said strengthening element comprises a regular pattern of said apertures.

46. The cabinet of claim 45, wherein said strengthening element has a honeycomb structure.

47. The cabinet of claim 32, wherein abutting apertures of adjacent columns form a plurality of rows that form an acute angle with the adjacent columns.

48. A cabinet comprising:

a top piece;

a bottom piece;

a first wall and a second wall, wherein said first and second walls are each attached to said top piece and said bottom piece so as to define an interior of said cabinet;

wherein said first wall comprises:

an inner wall facing said second wall and having a pair of holes spaced apart from one another;

an outer wall attached to said inner wall, wherein said inner wall and said outer wall define a cavity; and a strengthening element having a pattern of apertures facing said inner and outer walls, wherein said inner wall substantially covers all of said apertures so that said apertures are not exposed to said interior of said cabinet and wherein said strengthening element is positioned between said inner wall and said outer wall in said cavity and having a thickness so as to contact said inner wall and said outer wall, said strengthening element positioned between said pair of holes, wherein said pattern of apertures comprises a plurality of interconnected columns having two or more vertically aligned apertures and no two abutting apertures of adjacent columns form a horizontal row, a shelf attached to said first wall via said pair of holes, and said shelf is attached to said second wall; and wherein a volume of space, exclusive of said strengthening element and said apertures, is defined, where the cavity consists essentially of said volume of space, said strengthening element and said apertures, wherein said space is devoid of any materials that strengthen said first wall and said volume of space is greater than the combined volume of said strengthening element and said apertures.

49. The cabinet of claim 48, wherein said pattern of apertures comprises a regular pattern of said apertures.

50. The cabinet of claim 49, wherein said strengthening element has a honeycomb structure.

51. The cabinet of claim 50, wherein said strengthening element is attached to said inner wall and said outer wall.

52. The cabinet of claim 48, wherein said pattern of apertures comprises a hexagon.

53. The cabinet of claim 48, wherein said first wall has a strength such that said first wall does not require a frame for support.

54. The cabinet of claim 48, wherein said inner wall comprises a first row of holes laterally spaced apart from a second row of holes.

55. The cabinet of claim 54, wherein said first row and said second row are a predetermined distance apart from each other.

56. The cabinet of claim 55, wherein said second wall comprises:

a second inner wall facing said first wall and having a second pair of holes spaced apart from one another;

a second outer wall attached to said second inner wall, wherein said second inner wall and said second outer wall define a second cavity; and a second strengthening element having a pattern of apertures facing said second inner and outer walls and positioned between said second inner wall and said second outer wall in said cavity, said second strengthening element having a thickness so as to contact said second inner wall and said second outer wall, said second strengthening element positioned between said second pair of holes; and said shelf is attached to said second wall via said second pair of holes.

57. The cabinet of claim 56, wherein said second inner wall comprises a third row of holes laterally spaced apart from a fourth row of holes.

58. The cabinet of claim 57, wherein said third row of holes and said fourth row of holes are a predetermined distance apart from each other.

59. The cabinet of claim 48, wherein abutting apertures of adjacent columns are vertically offset from one another.

60. The cabinet of claim 59, wherein abutting apertures of adjacent columns form a plurality of rows that form an acute angle with the adjacent columns.

61. The cabinet of claim 48, wherein abutting apertures of adjacent columns form a plurality of rows that form an acute angle with the adjacent columns.

62. The cabinet of claim 48, wherein said second wall comprises:

a second inner wall facing said first wall and having a second pair of holes spaced apart from one another;

a second outer wall attached to said second inner wall, wherein said second inner wall and said second outer wall define a second cavity; and a second strengthening element having a pattern of apertures facing said second inner and outer walls and positioned between said second inner wall and said second outer wall in said cavity, said second strengthening element having a thickness so as to contact said second inner wall and said second outer wall, said second strengthening element positioned between said second pair of holes; and said shelf is attached to said second wall via said second pair of holes.

63. The cabinet of claim 62, wherein said pattern of apertures for said second strengthening element comprises a regular pattern of said apertures.

64. The cabinet of claim 63, wherein said second strengthening element has a honeycomb structure.

65. The cabinet of claim 64, wherein said second strengthening element is attached to said second inner wall and said second outer wall.

66. The cabinet of claim 62, wherein said pattern of apertures for said second strengthening element comprises a hexagon.

67. The cabinet of claim 62, wherein said second wall has a strength such that said first wall does not require a frame for support.

68. The cabinet of claim 62, wherein said second inner wall comprises a first row of holes laterally spaced apart from a second row of holes.

69. The cabinet of claim 68, wherein said first row of holes and said second row of holes are a predetermined distance apart from each other.

* * * * *